US007654589B2

(12) United States Patent
Vickers et al.

(10) Patent No.: US 7,654,589 B2
(45) Date of Patent: Feb. 2, 2010

(54) ROTARY ACTION DRAW LATCH

(75) Inventors: James H. Vickers, Media, PA (US); Ian Vance White, Landenberg, PA (US); David Arnold White, Landenberg, PA (US); Joshua James Baker, Philadelphia, PA (US)

(73) Assignee: Southco, Inc., Concordville, PA (US)

( * ) Notice: Subject to any disclaimer, the term of this patent is extended or adjusted under 35 U.S.C. 154(b) by 181 days.

(21) Appl. No.: 11/676,270

(22) Filed: Feb. 16, 2007

(65) Prior Publication Data

US 2007/0205608 A1 Sep. 6, 2007

Related U.S. Application Data

(60) Provisional application No. 60/774,877, filed on Feb. 16, 2006.

(51) Int. Cl.
*E05C 5/00* (2006.01)
*E05C 3/04* (2006.01)

(52) U.S. Cl. ..... 292/113; 292/210; 292/DIG. 31

(58) Field of Classification Search ..... 292/95, 292/100–102, 108, 200, 210, 247, 250, 304, 292/DIG. 20, DIG. 31, DIG. 47, 113; 70/208, 70/210

See application file for complete search history.

(56) References Cited

U.S. PATENT DOCUMENTS 297,499 A * 4/1884 Church ..... 292/210
2,374,394 A * 4/1945 Tessier ..... 292/257
D187,492 S 3/1960 Humphries
D188,469 S 7/1960 Humphries
3,030,137 A 4/1962 Cheney
4,181,333 A * 1/1980 Stelma ..... 292/66
4,370,874 A * 2/1983 Munn ..... 70/204
4,540,206 A 9/1985 Frame et al.
4,705,308 A 11/1987 Bisbing
4,890,869 A 1/1990 Langkamp, Jr.
5,042,855 A * 8/1991 Bennett et al. ..... 292/241
5,271,649 A 12/1993 Gromotka
D362,413 S 9/1995 Takimoto
5,452,926 A 9/1995 Takimoto
5,478,125 A 12/1995 Gromotka
D366,856 S 2/1996 Takimoto (Continued)

OTHER PUBLICATIONS

Southco, Inc. Handbook 2003, Front and Back Covers and color pp. 169-199.

(Continued)

*Primary Examiner*—Carlos Lugo
*Assistant Examiner*—Alyson M Merlino
(74) *Attorney, Agent, or Firm*—Paul & Paul

(57) ABSTRACT

A latching system including a latch assembly, a cup, and a keeper plate. The latch assembly includes a base, a lever, and a catch. The lever is pivotally connected to the base and the catch is pivotally connected to the lever. The base is pivotally attached to the cup such that it rotates about an axis of rotation that is perpendicular in direction in relation to the direction of the axis of rotation of the lever relative to the base. The keeper plate includes a keeper projection. The lever can be lifted and the latch assembly rotated about the axis of rotation of the base to clear the keeper from the catch and thereby allow the opening of a first closure member relative to a second closure member.

9 Claims, 40 Drawing Sheets

U.S. PATENT DOCUMENTS

| | | | | |
|---|---|---|---|---|
| D370,619 | S | | 6/1996 | Hall et al. |
| D371,954 | S | | 7/1996 | Ford et al. |
| D374,806 | S | | 10/1996 | Ford et al. |
| D377,141 | S | | 1/1997 | Ford et al. |
| D377,446 | S | | 1/1997 | Ford et al. |
| 5,655,799 | A | | 8/1997 | Takimoto |
| 5,667,258 | A | | 9/1997 | Takimoto |
| 6,076,865 | A | | 6/2000 | Sokurenko et al. |
| 6,179,350 | B1 | | 1/2001 | Ely et al. |
| 6,257,631 | B1 | | 7/2001 | Sokurenko et al. |
| 6,457,750 | B1 | | 10/2002 | Sokurenko et al. |
| D533,434 | S | | 12/2006 | Riblett et al. |
| D548,565 | S | * | 8/2007 | Vickers ..... D8/331 |

OTHER PUBLICATIONS

Southco, Inc. Handbook 2005, Front and Back Covers and color pp. 66-83.

Photographs from www.adamhall.com, Feb. 2006.

Photographs from www.adamhall.com, May 2006.

* cited by examiner 104
108
112
110

104
114
114
112
114
108
118
120
124
140
116
122
114
114

106
130
128
126
128

132
138
132
134
136
126
128
132
141
132
130
106

144
162
164
166
168
170
172
174
176
178
180
182
184
248

250
188
146
202
186
192
200

188
202
186
190
146

252
190
146
202
194
186
196
192
200

250
188
202
186
146
190
252
192
194
200

186
192
146
194
200

114
258
114
112
114
260
114
262
114
114
258
114
104a
140
122
120
118
116
108
124

114
114
114
266
104a
260
262
122
120
110
108
114
110
118
116
124
108
258
114
268
114
112
110

112
110
104a 144a
162
164
166
168
170
172
174
176
178
180
182
184
248
272
274
276
278

ROTARY ACTION DRAW LATCH

CROSS REFERENCE TO RELATED APPLICATIONS

This application claims the benefit of the priority of U.S. Provisional Application for Patent Ser. No. 60/774,877, filed on Feb. 16, 2006, which is incorporated herein by reference in its entirety.

BACKGROUND OF THE INVENTION

1. Field of Invention

This invention relates to a latch for securing a first closure member in a closed position relative to a second closure member.

2. Brief Description of the Related Art

Over-center draw latches are so called because in their latching action they draw two closure members together before securing them in the closed position. The closure members may be any type of door, doorframe, compartment, lid, or the halves of a carrying case shell. Draw latches include a base, a lever and a catch. The base and the lever are pivotally connected to each other, and the catch and the lever are pivotally connected to each other. A keeper is usually provided on a first closure member, and the base is installed to a second closure member. The catch and the keeper can cooperate to secure the first closure member in a closed position relative to the second closure member when the latch is in a latched configuration. Many examples of draw latches are known in the prior art. However, none are seen to provide the unique and novel features of the present invention.

SUMMARY OF THE INVENTION

The present invention is directed to a latching system that includes a latch assembly, a cup, and a keeper plate. The latch assembly includes a base, a lever, and a catch. The lever is pivotally connected to the base and the catch is pivotally connected to the lever. A biasing means is provided that acts between the catch and the lever to bias the catch and the lever toward their latched positions relative to the base. The base is pivotally attached to the cup such that it rotates about an axis of rotation that is perpendicular in direction in relation to the direction of the axis of rotation of the lever relative to the base. The axis of rotation of the catch relative to the lever is parallel to the axis of rotation of the lever relative to the base. The keeper plate includes a keeper projection that can cooperate with the catch to secure the first closure member in the closed position relative to the second closure member when the latch assembly is in a latched configuration. The lever can be lifted and the latch assembly rotated about the axis of rotation of the base to clear the keeper from the catch and thereby allow the opening of the first closure member relative to the second closure member.

BRIEF DESCRIPTION OF THE DRAWINGS

FIGS. 9-14 are views of the keeper plate of the first embodiment of the latching system in accordance with the present invention.

FIGS. 72-76 are views of the lock cylinder and pawl of the second embodiment of the latching system in accordance with the present invention.

Like reference numerals indicate like elements throughout the several views.

DETAILED DESCRIPTION OF THE INVENTION

Figure 1:
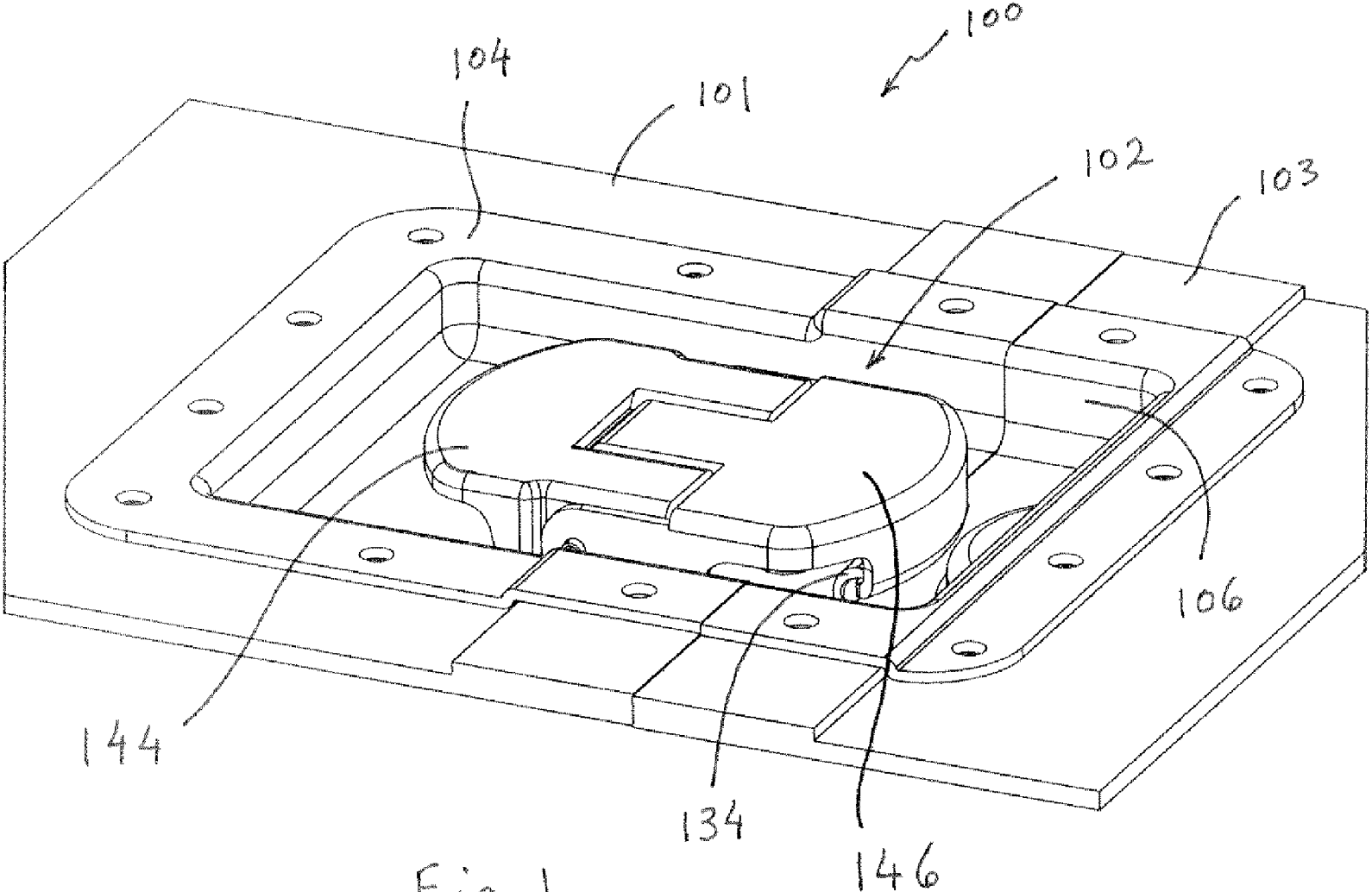
FIG. 1 is an environmental perspective view of a first embodiment of the latching system in accordance with the present invention, with the latching system shown in a latched condition or configuration.
Figure 2:
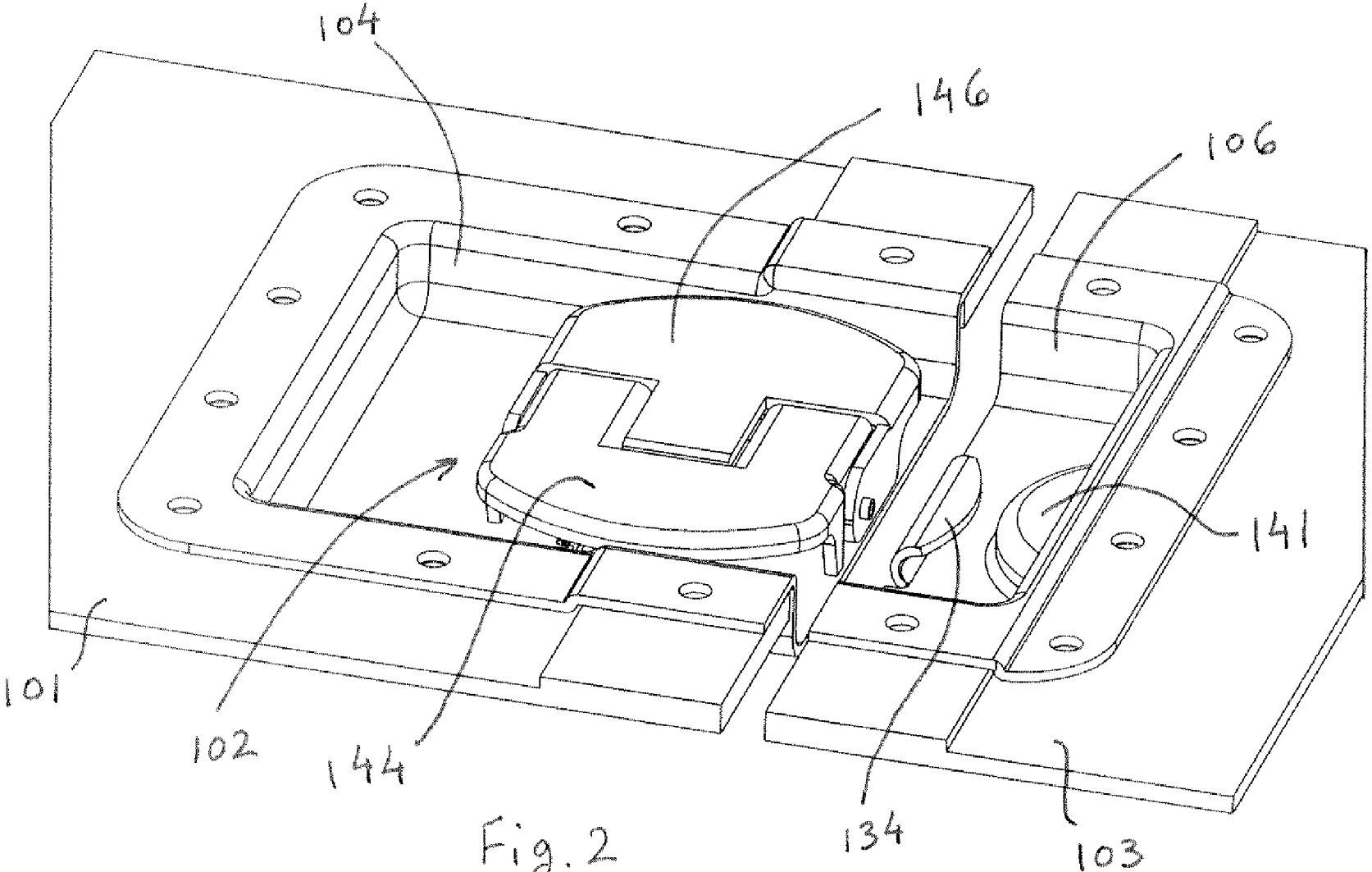
FIG. 2 is an environmental perspective view of a first embodiment of the latching system in accordance with the present invention, with the latching system shown in an unlatched condition or configuration and with the lever and catch of the latch assembly in their latched positions relative to the base of the latch assembly.
Figure 3:
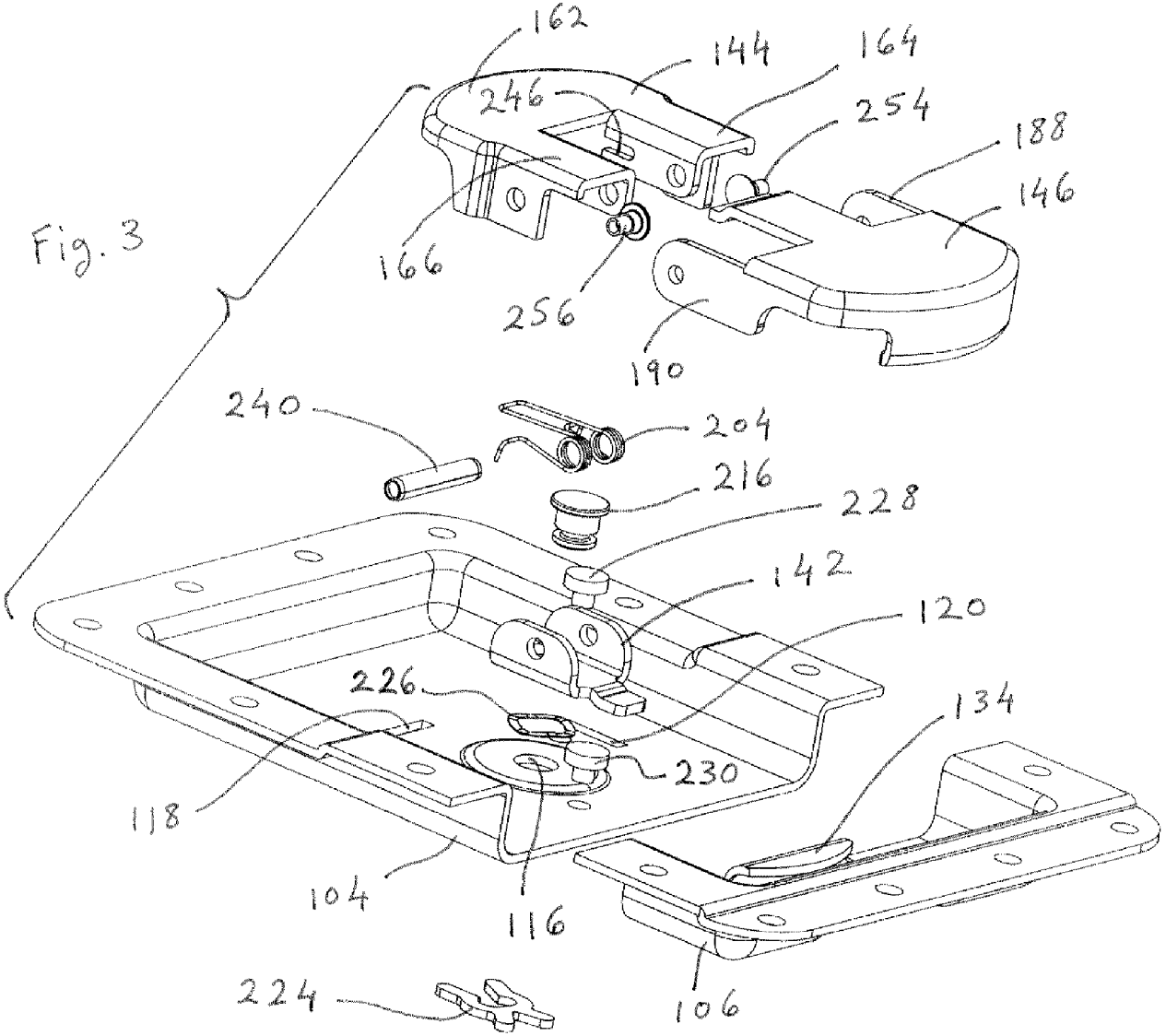
FIG. 3 is an exploded view of a first embodiment of the latching system in accordance with the present invention.
Figures 4, 5, 6:
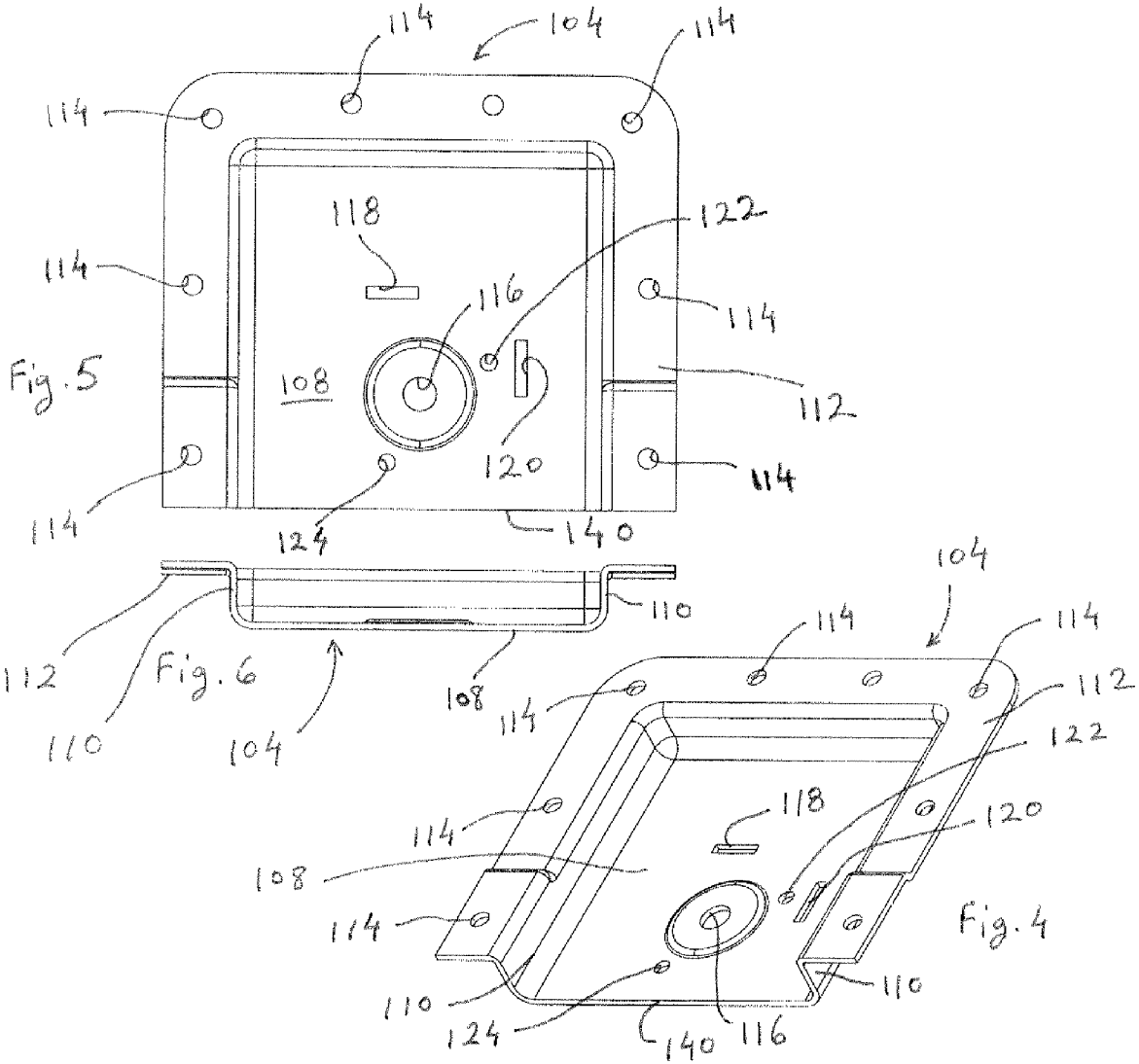
FIGS. 4-8 are views of the cup of the first embodiment of the latching system in accordance with the present invention.
Figures 7, 8:
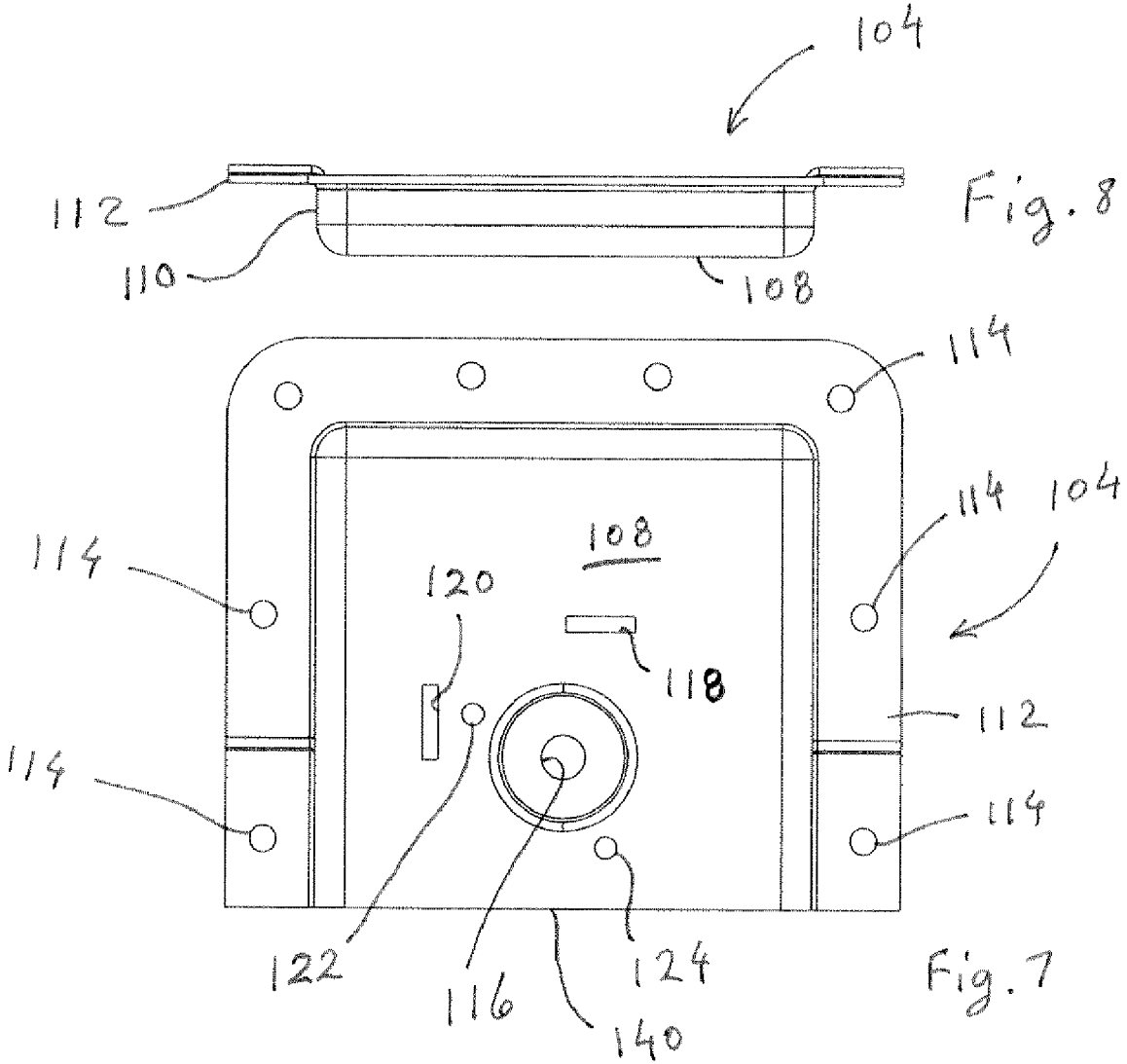
Figures 9, 10:
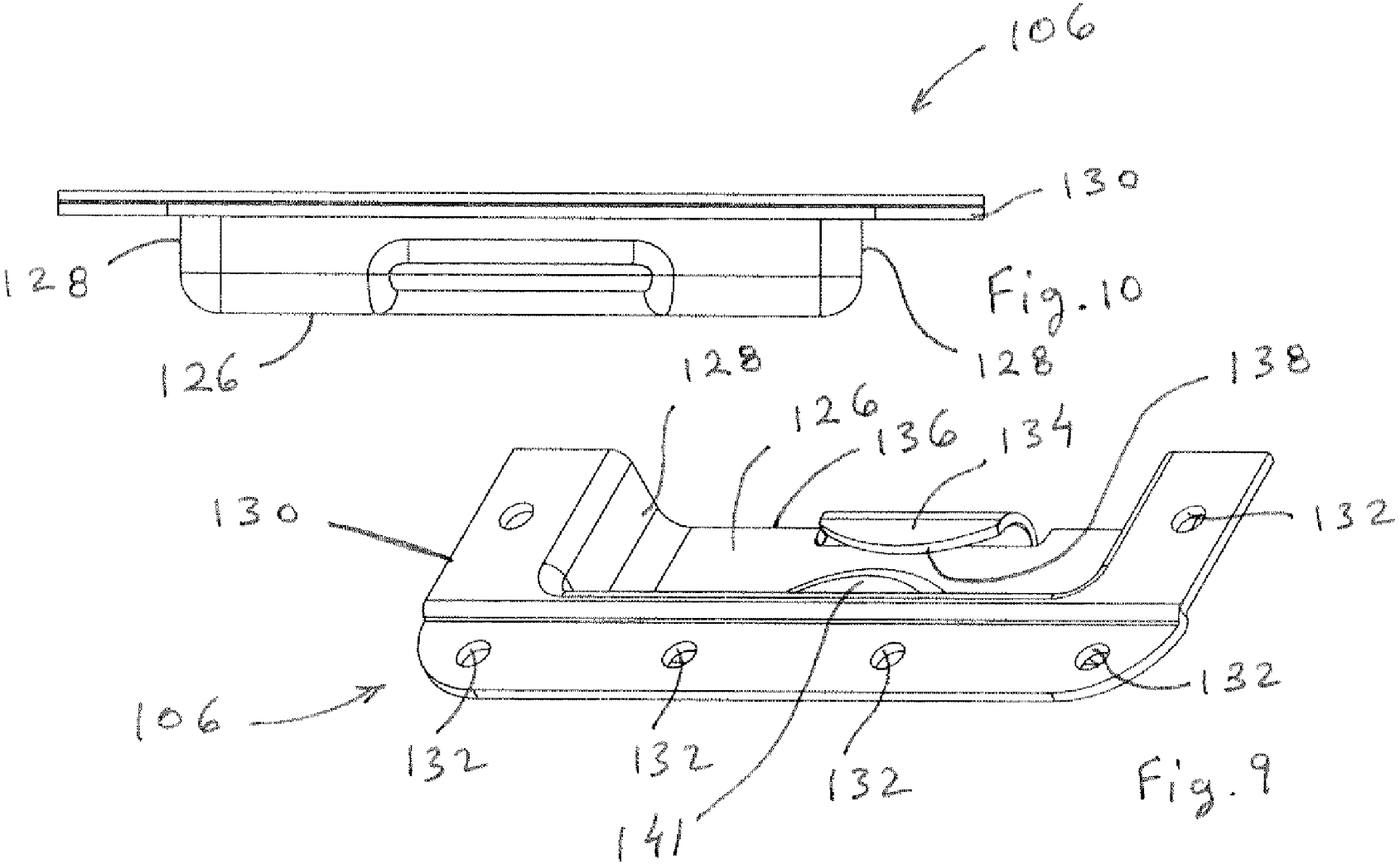
Figure 11:
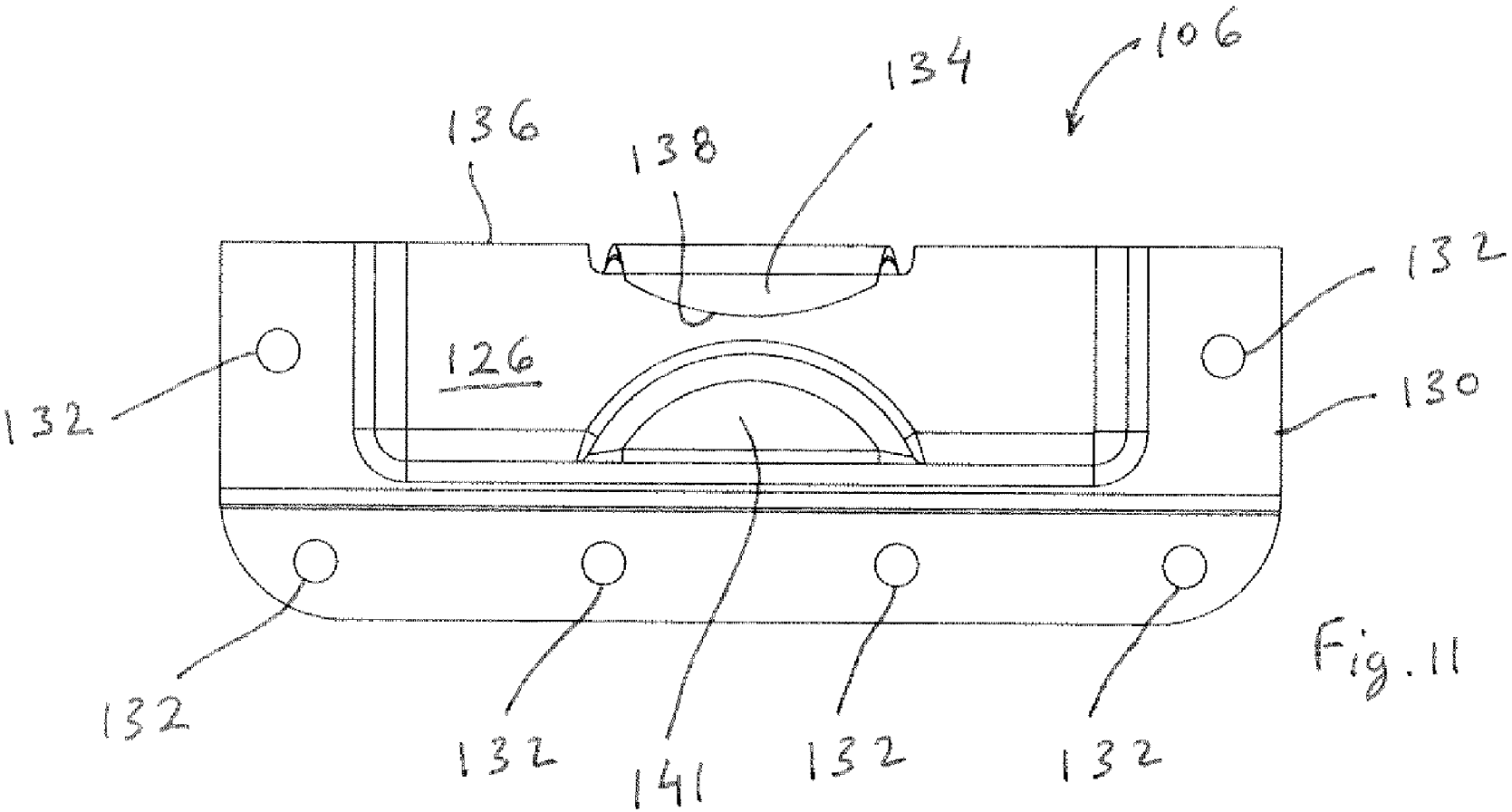
Figure 12:
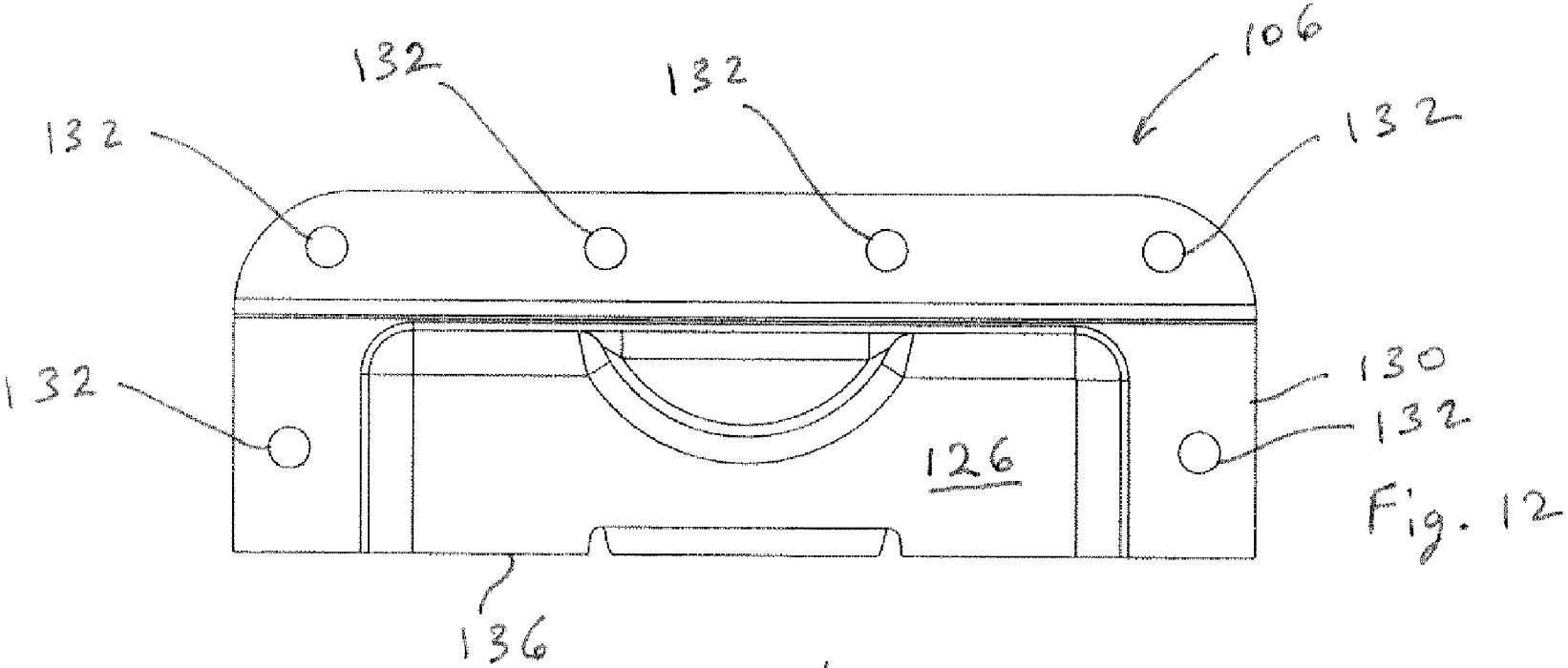
Figure 13:
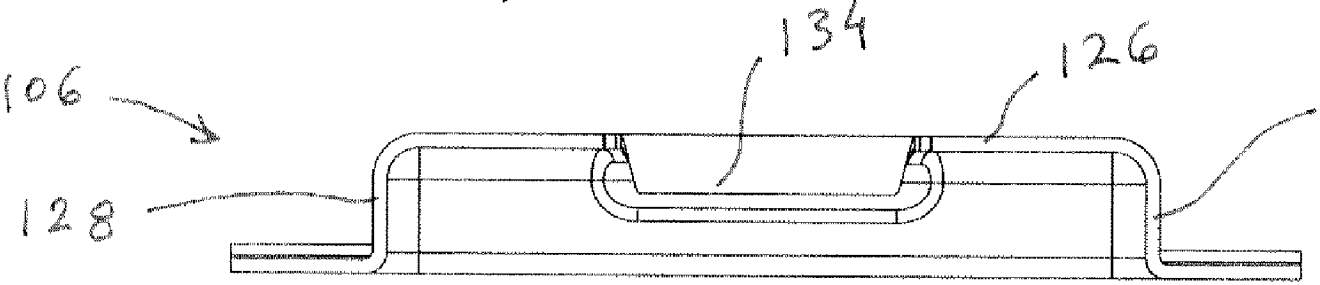
Figure 9A:
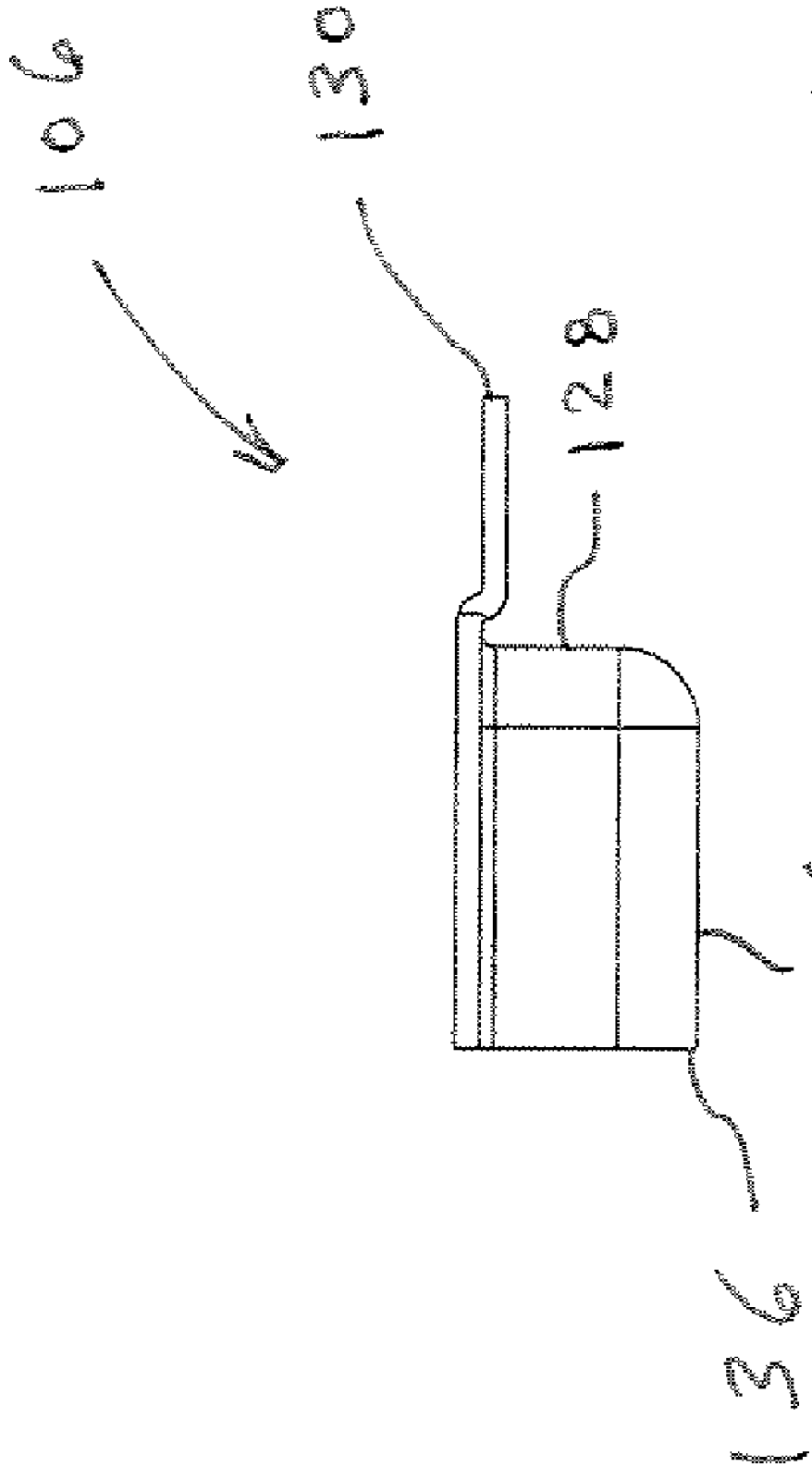
Figure 15:
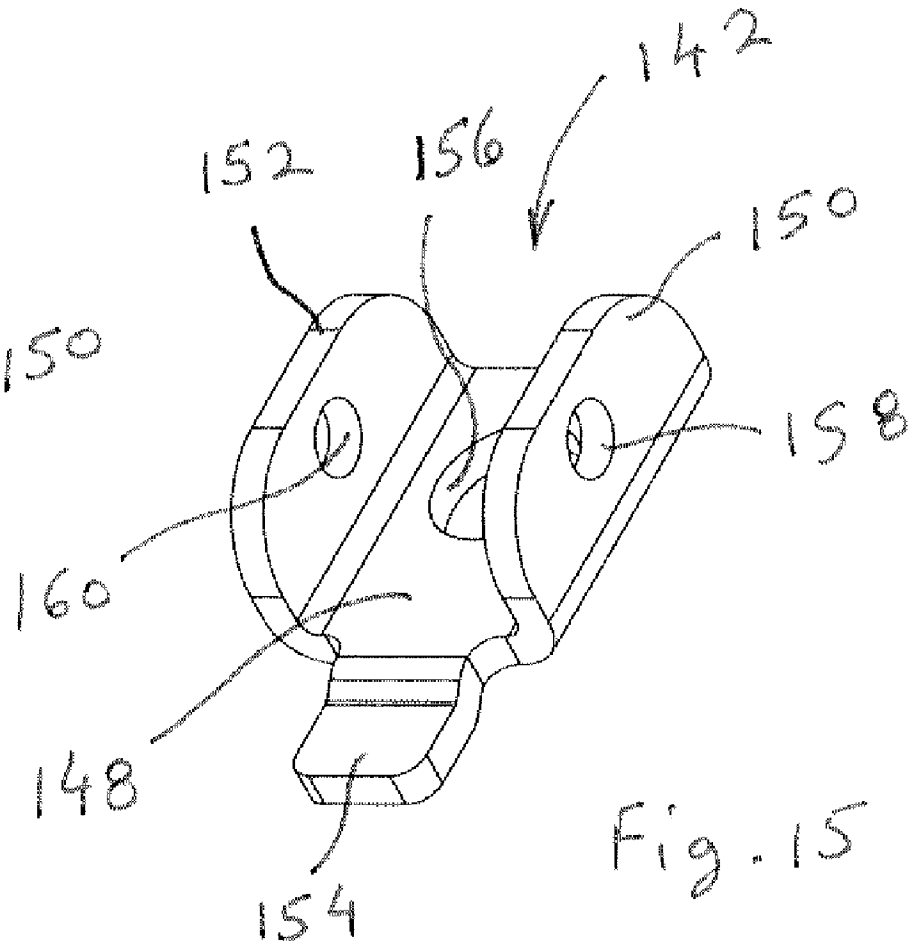
FIGS. 15-21 are views of the base of the latch assembly of the first embodiment of the latching system in accordance with the present invention.
Figure 16:
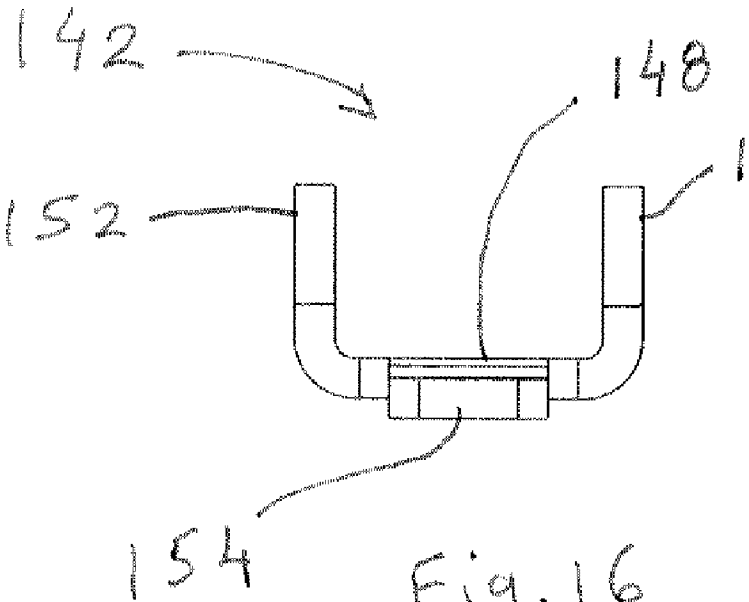
Figure 17:
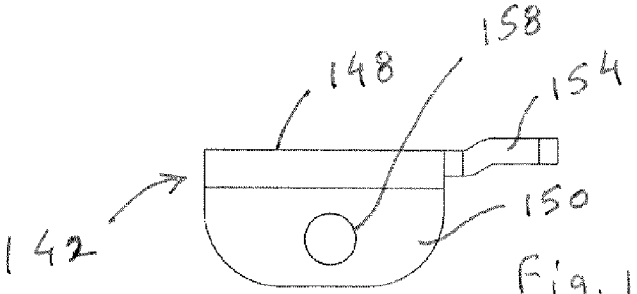
Figure 18:
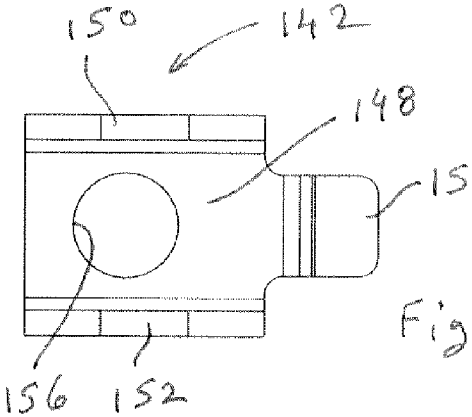
Figure 19:
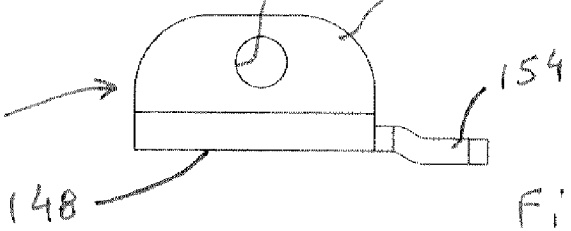
Figure 20:
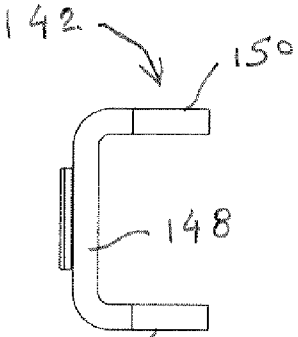
Figure 21:
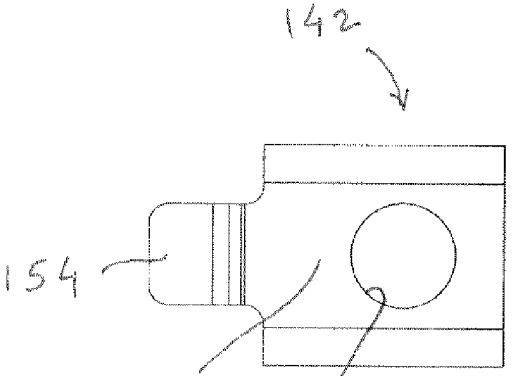
Figures 22, 23, 24, 25, 26:
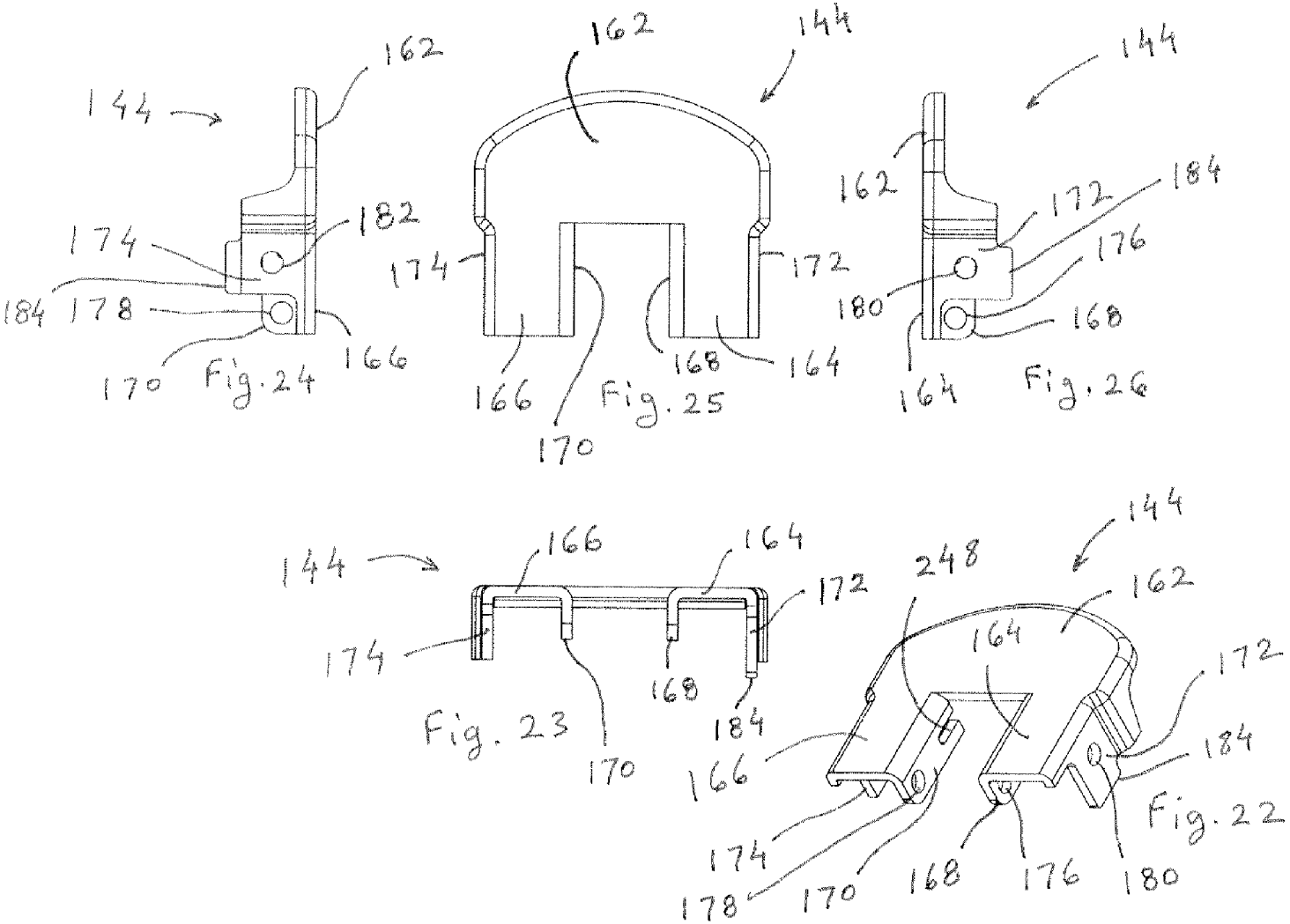
FIGS. 22-28 are views of the lever of the latch assembly of the first embodiment of the latching system in accordance with the present invention.
Figure 27:
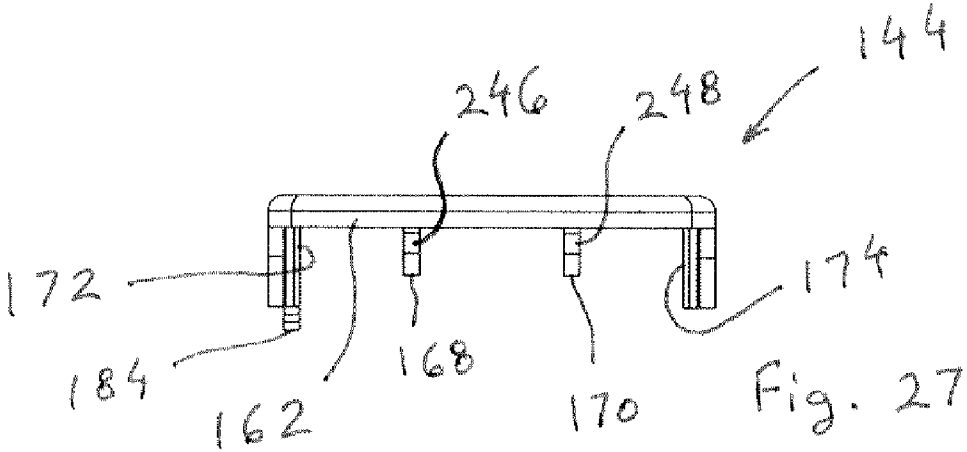
Figure 28:
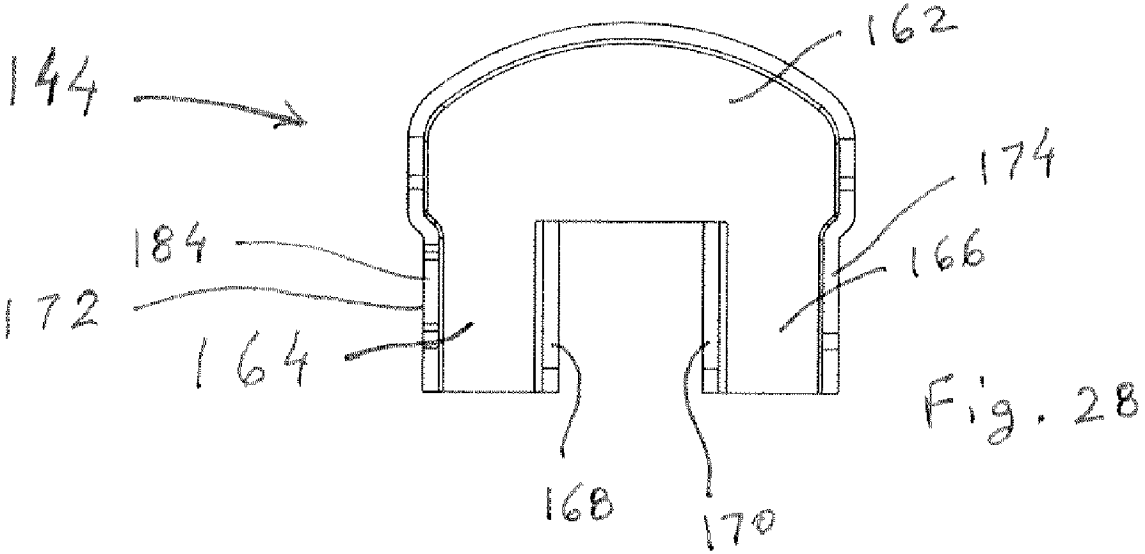
Figures 29, 30, 31, 32, 33:
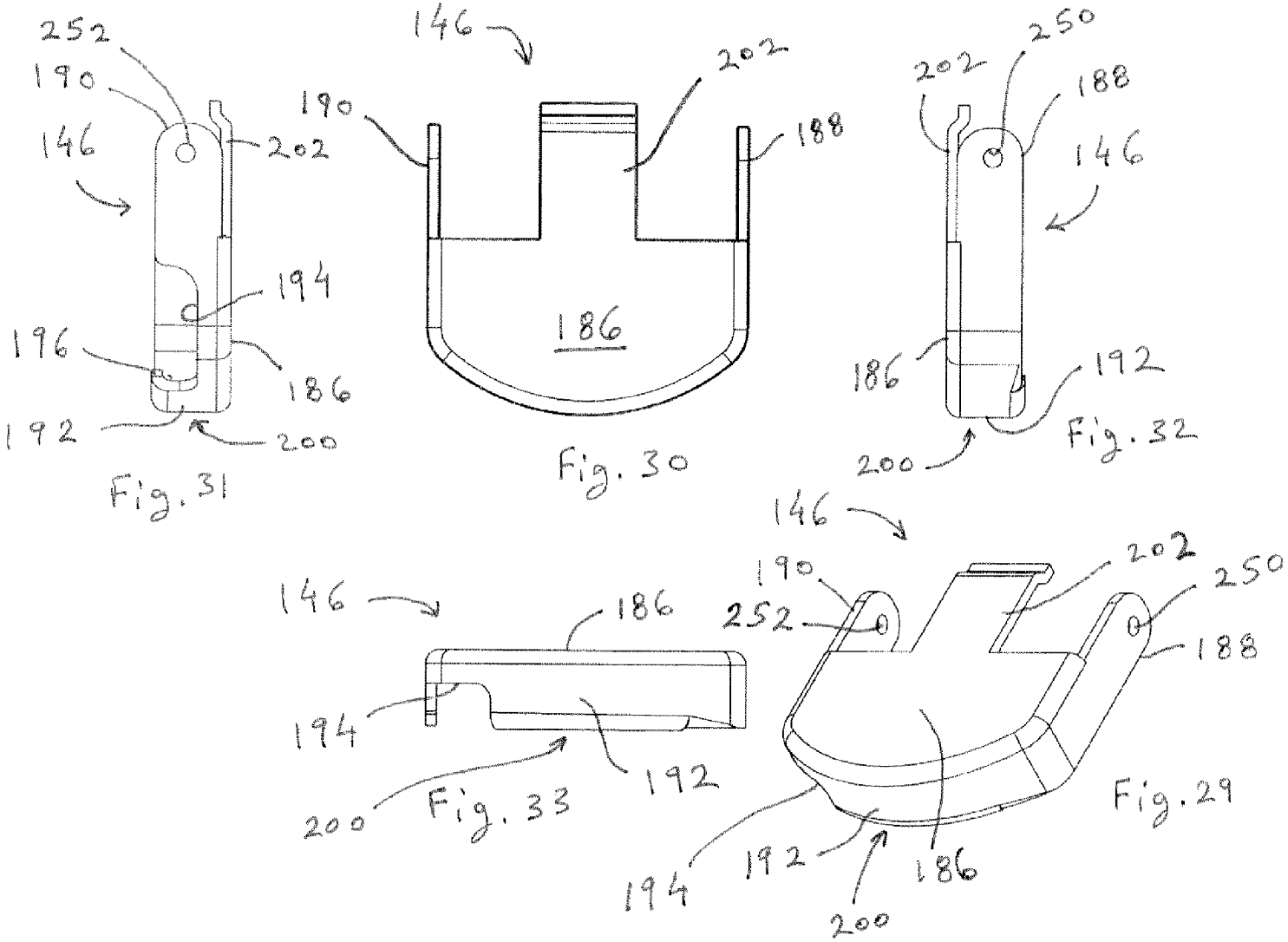
FIGS. 29-35 are views of the catch of the latch assembly of the first embodiment of the latching system in accordance with the present invention.
Figure 34:
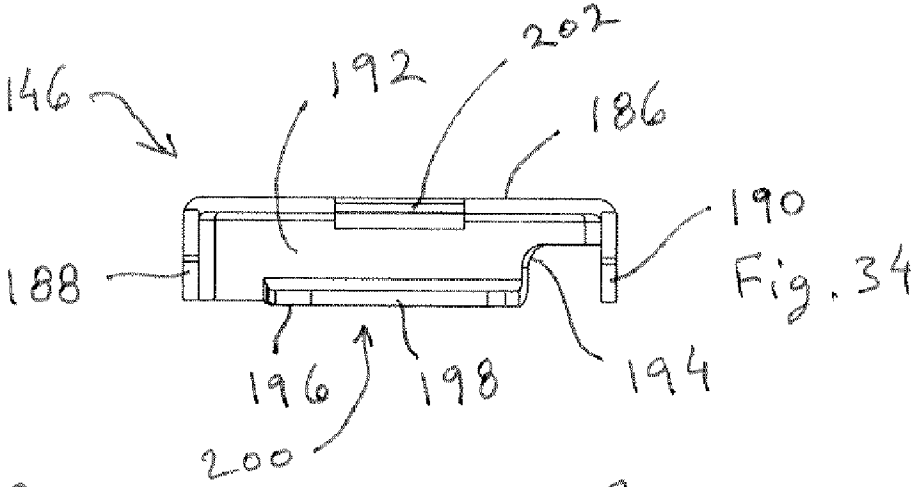
Figure 35:
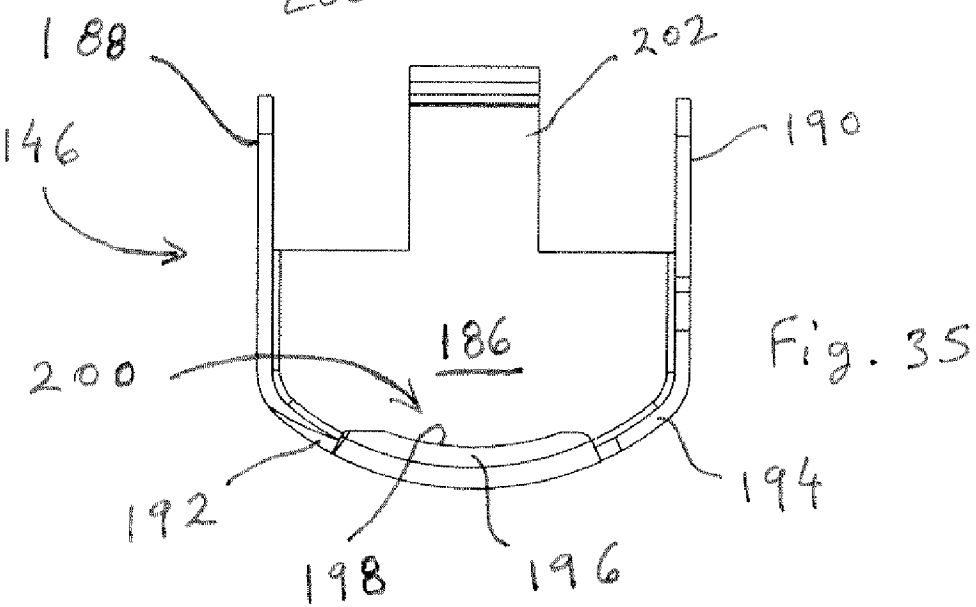
Figure 37:
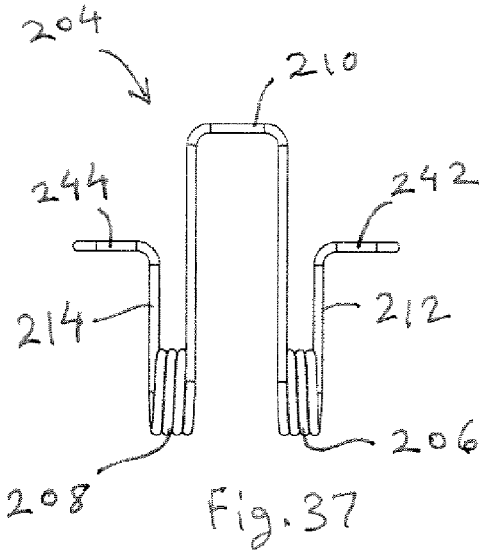
FIGS. 36-39 are views of the torsion spring of the latch assembly of the first embodiment of the latching system in accordance with the present invention.
Figure 38:
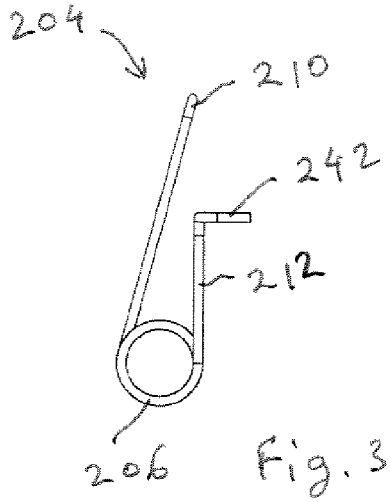
Figure 39:
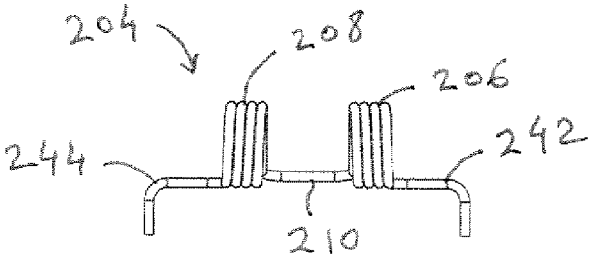
Figure 36:
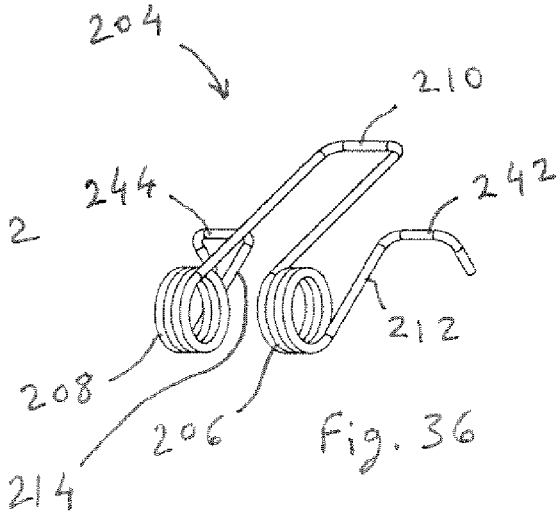
Figure 40:
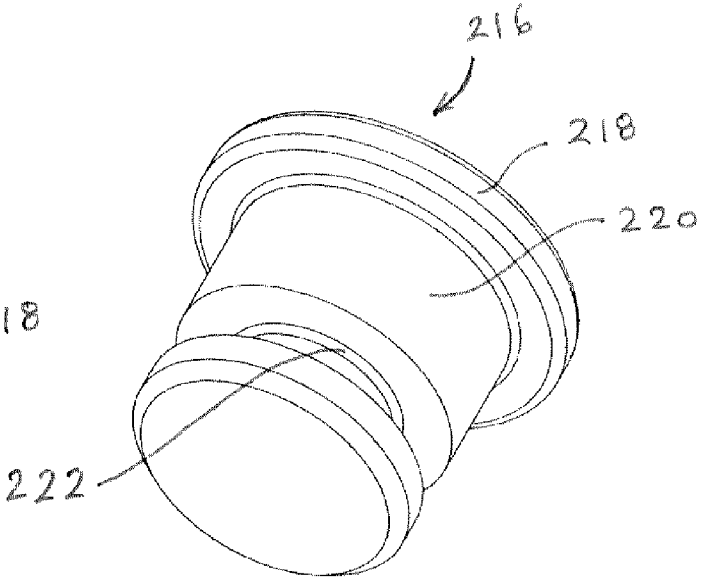
FIGS. 40-42 are views of the stud of the first embodiment of the latching system in accordance with the present invention.
Figure 41:
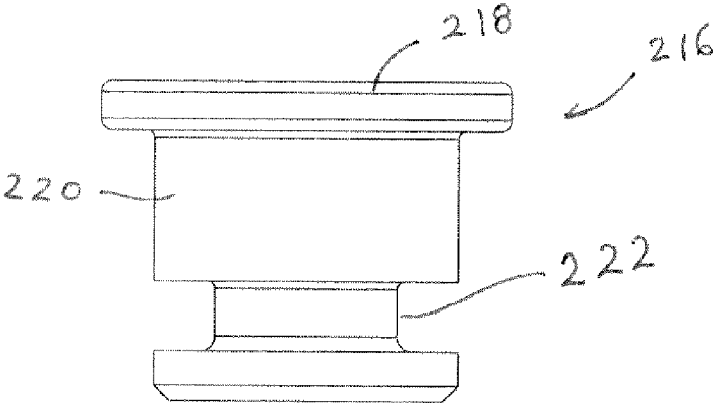
Figure 42:
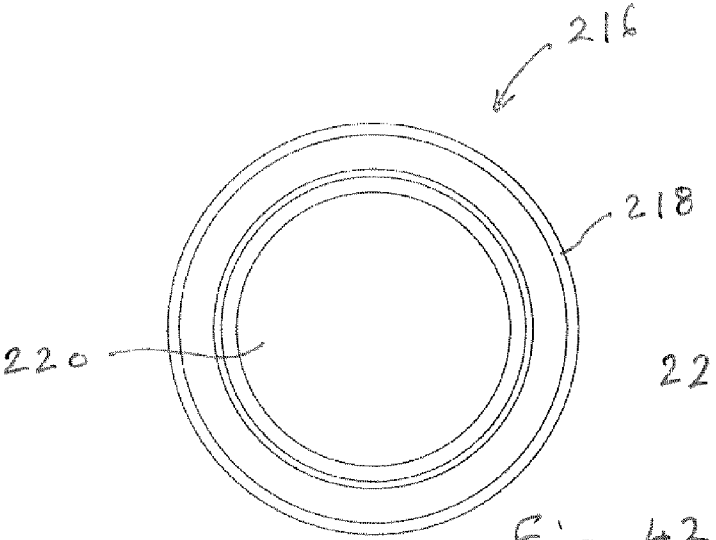
Figure 43:
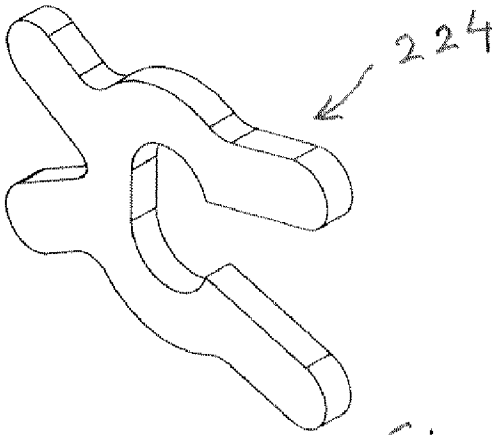
FIGS. 43-44 are views of the retaining ring of the first embodiment of the latching system in accordance with the present invention.
Figure 44:
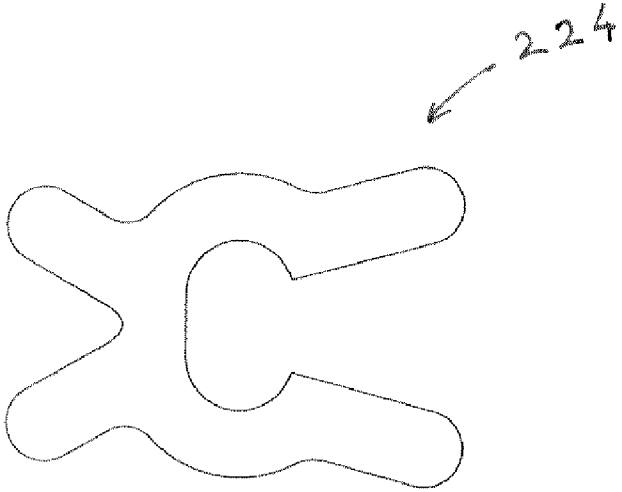
Figure 45:
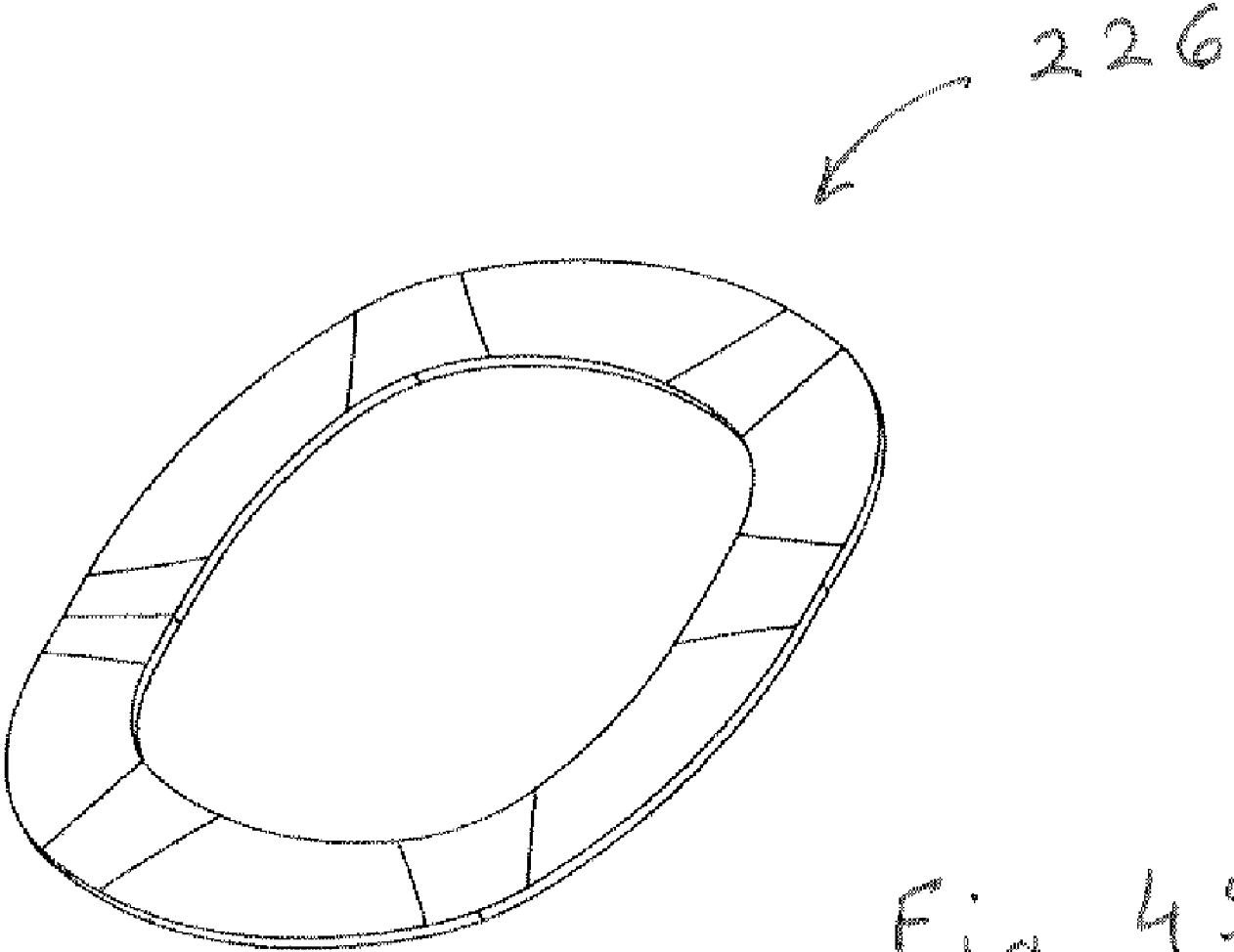
FIGS. 45-47 are views of the wave washer of the first embodiment of the latching system in accordance with the present invention.
Figure 46:
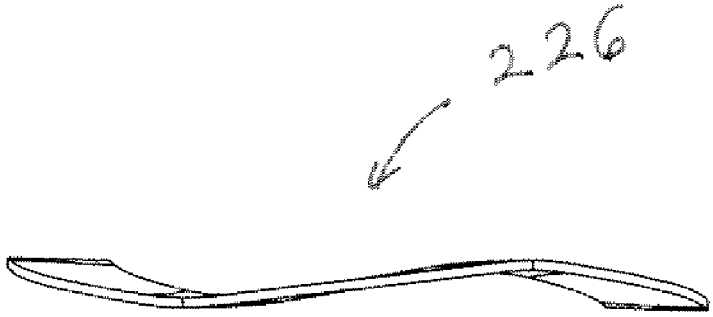
Figure 47:
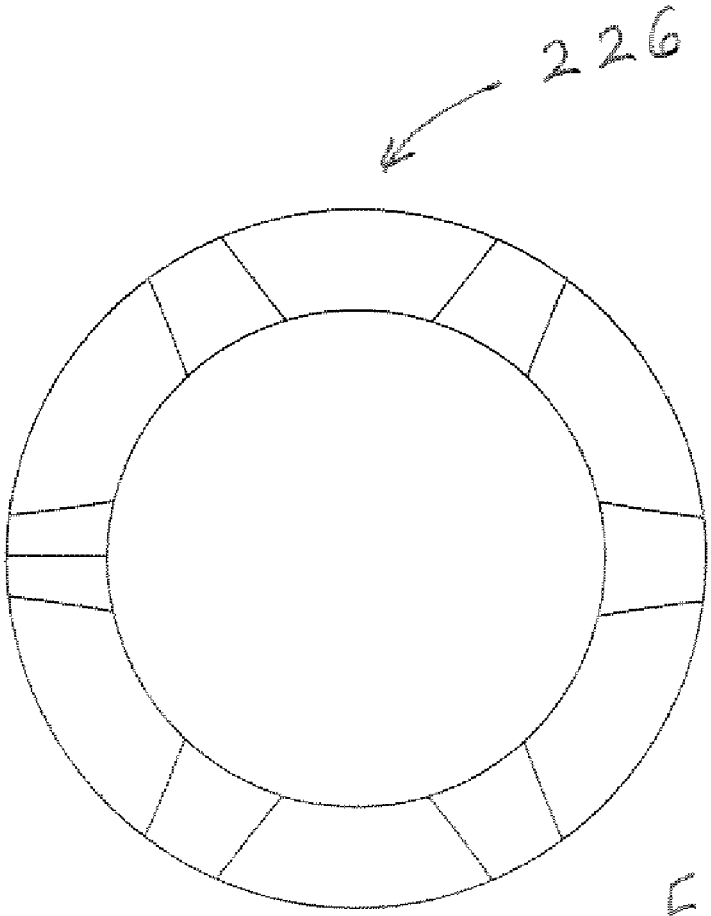
Figure 48:
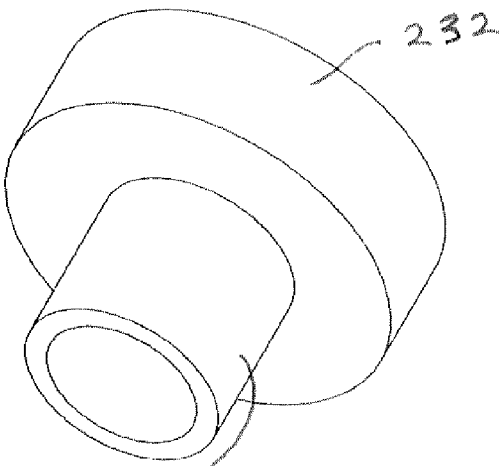
FIGS. 48-53 are views of the stop lugs of the first embodiment of the latching system in accordance with the present invention.
Figure 50:
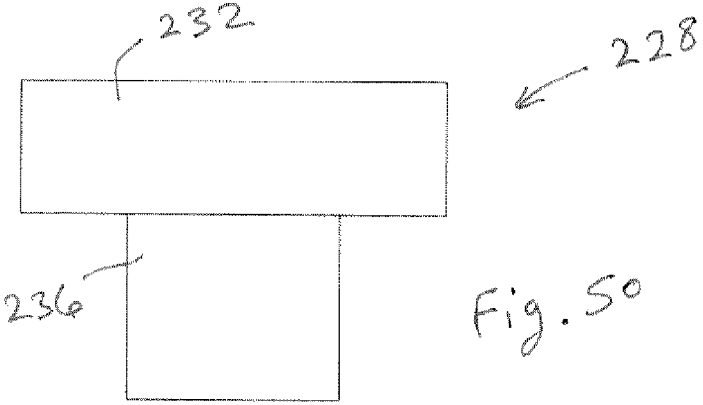
Figure 49:
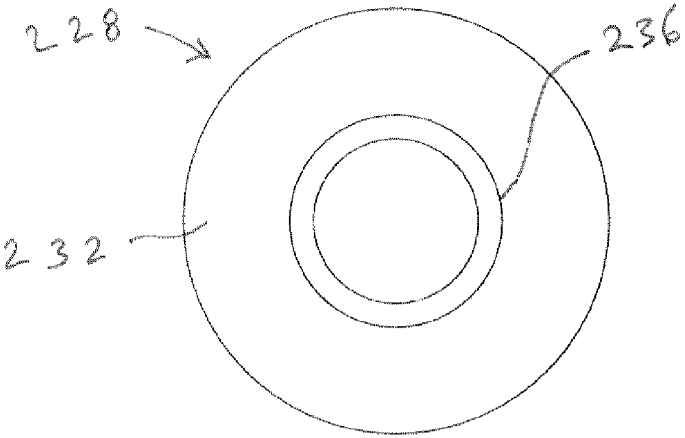
Figure 51:
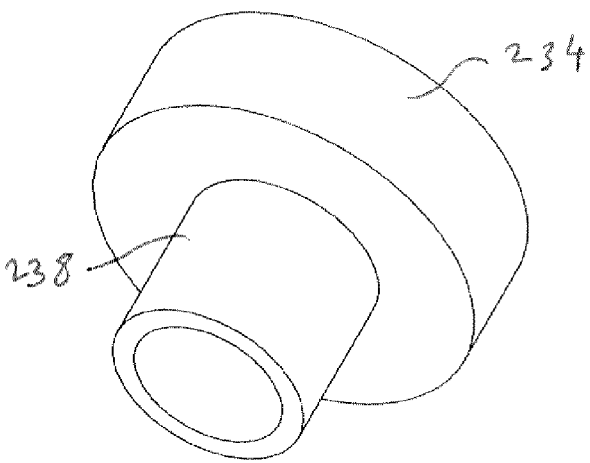
Figure 52:
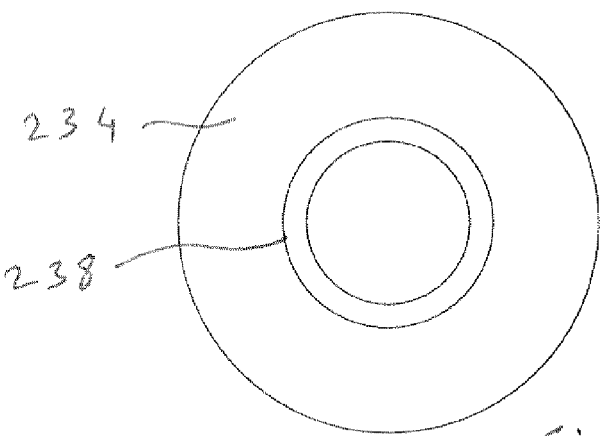
Figure 53:
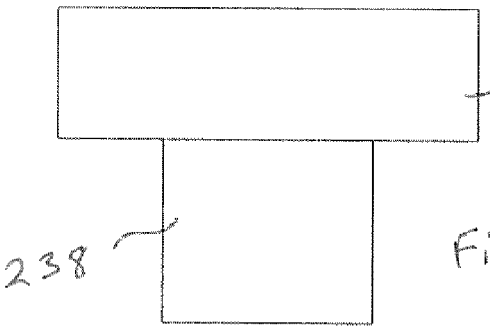
Figure 55:
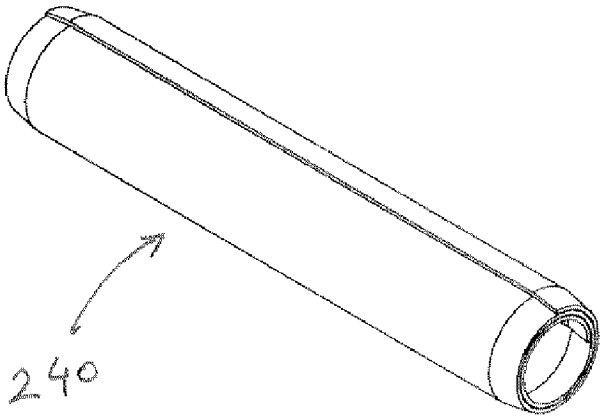
FIGS. 54-57 are views of the pin of the latch assembly of the first embodiment of the latching system in accordance with the present invention that pivotally connects the lever of the latch assembly to the base of the latch assembly.
Figure 54:
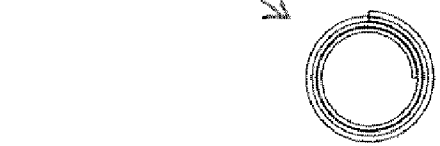
Figure 56:
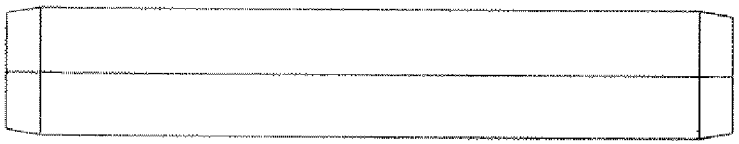
Figure 57:
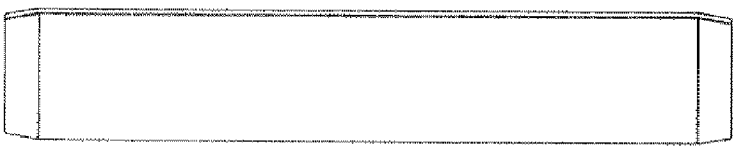
Figure 60:
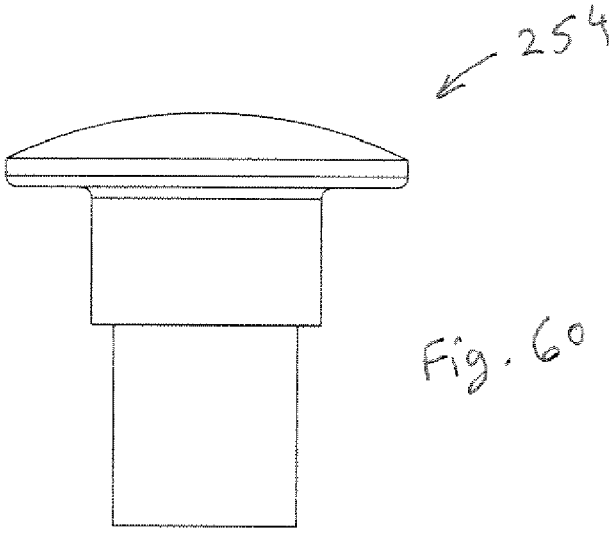
FIGS. 58-63 are views of the rivets used to pivotally connect the catch to the lever in the latch assembly of the first embodiment of the latching system in accordance with the present invention.
Figure 59:
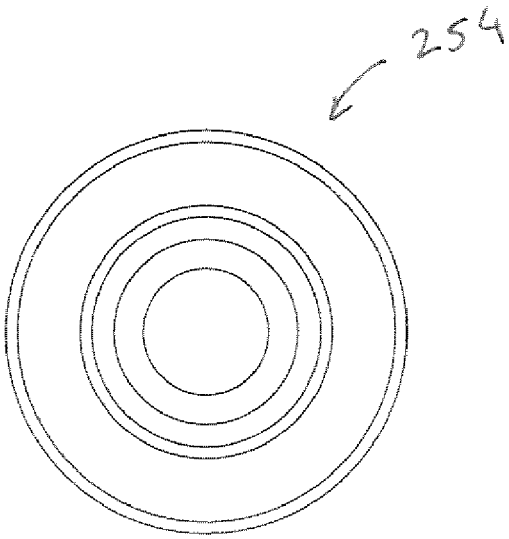
Figure 58:
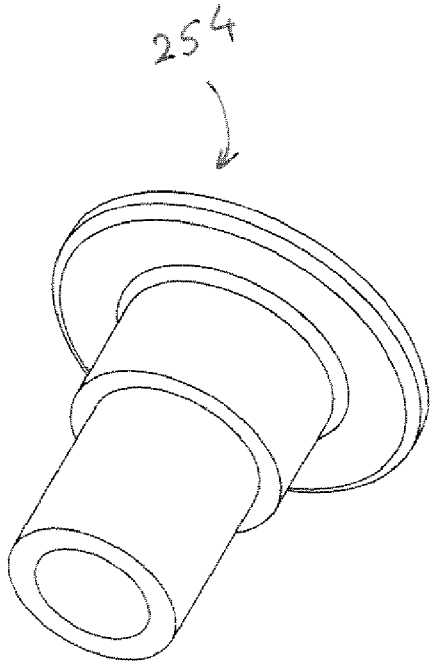
Figure 61:
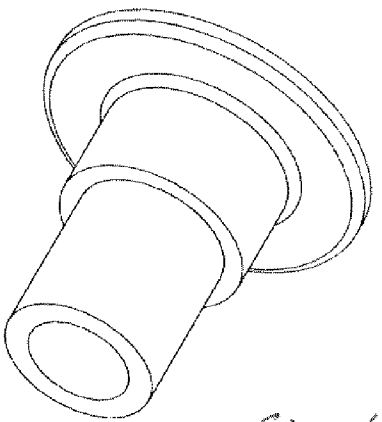
Figure 62:
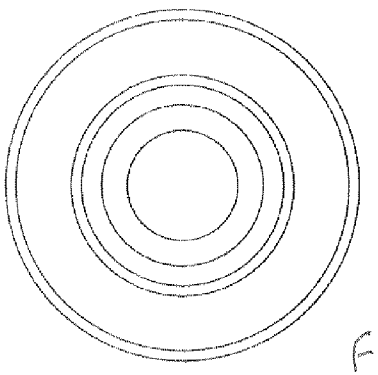
Figure 63:
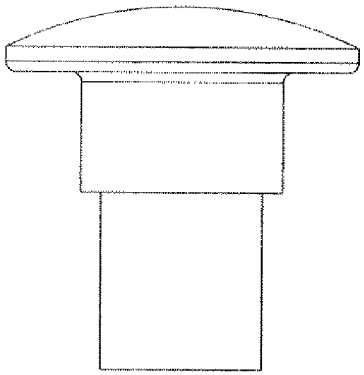
Figure 64:
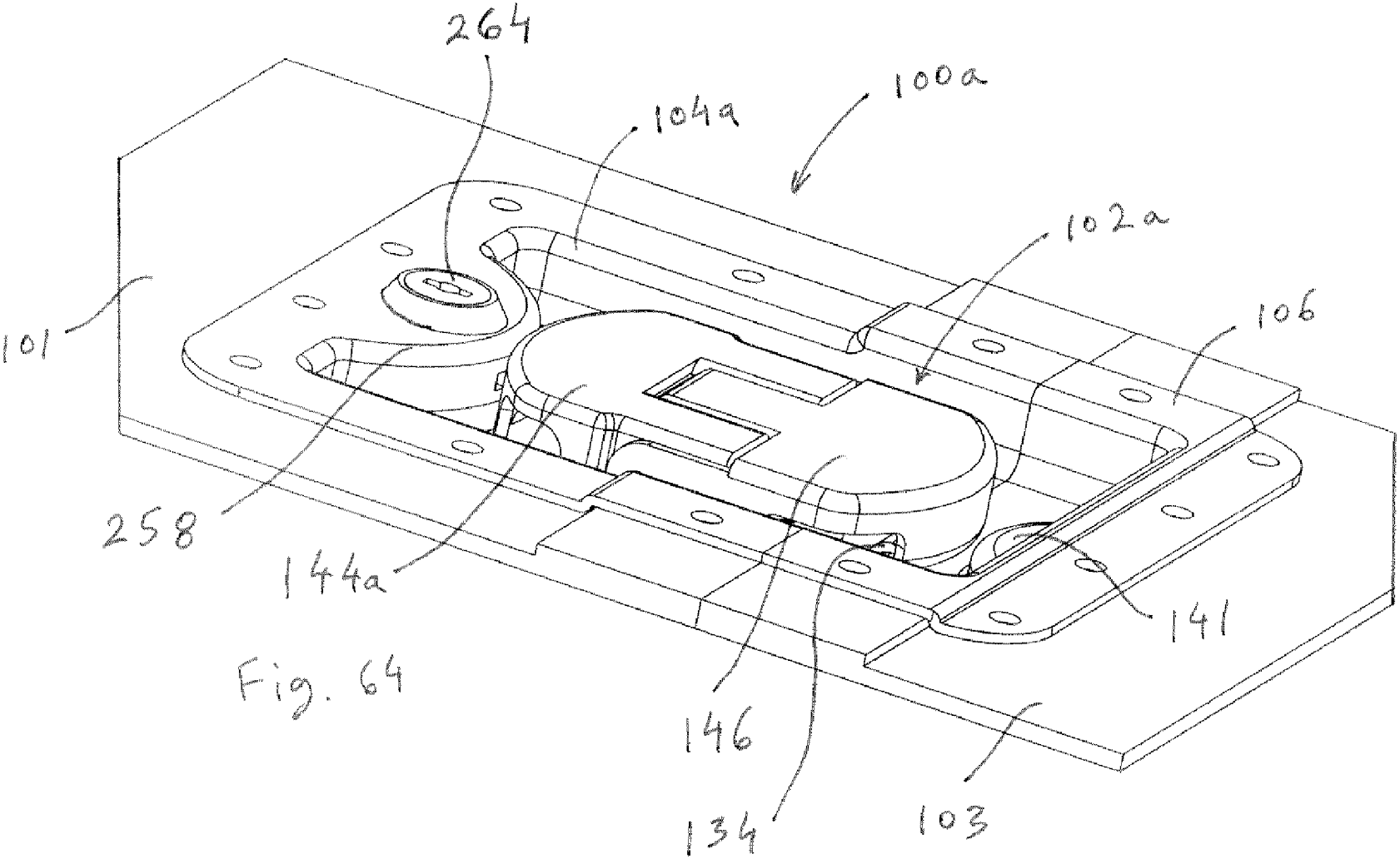
FIG. 64 is an environmental perspective view of a second embodiment of the latching system in accordance with the present invention, with the latching system shown in a latched condition or configuration.
Figure 65:
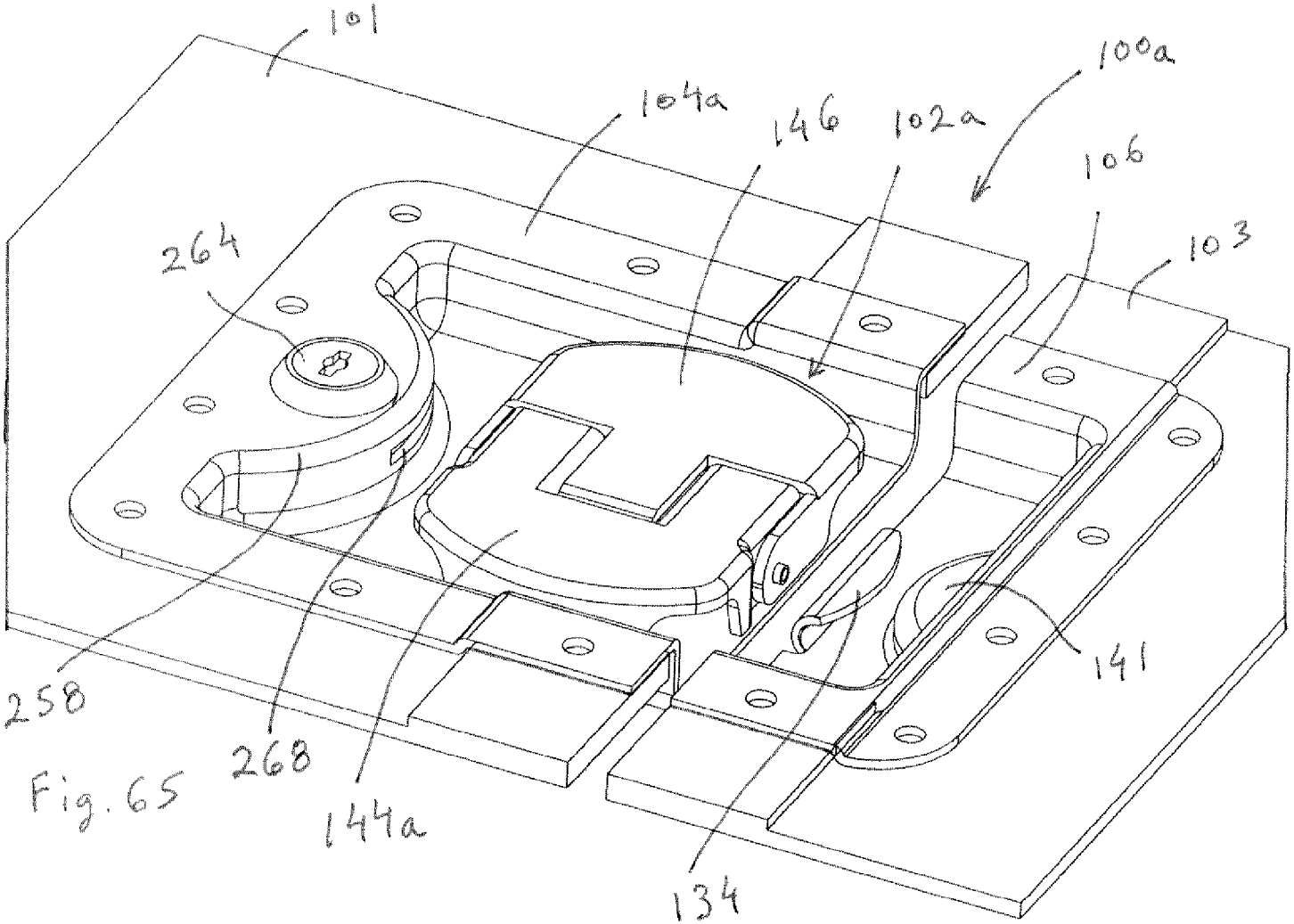
FIG. 65 is an environmental perspective view of the second embodiment of the latching system in accordance with the present invention, with the latching system shown in the unlatched condition or configuration.
Figure 66:
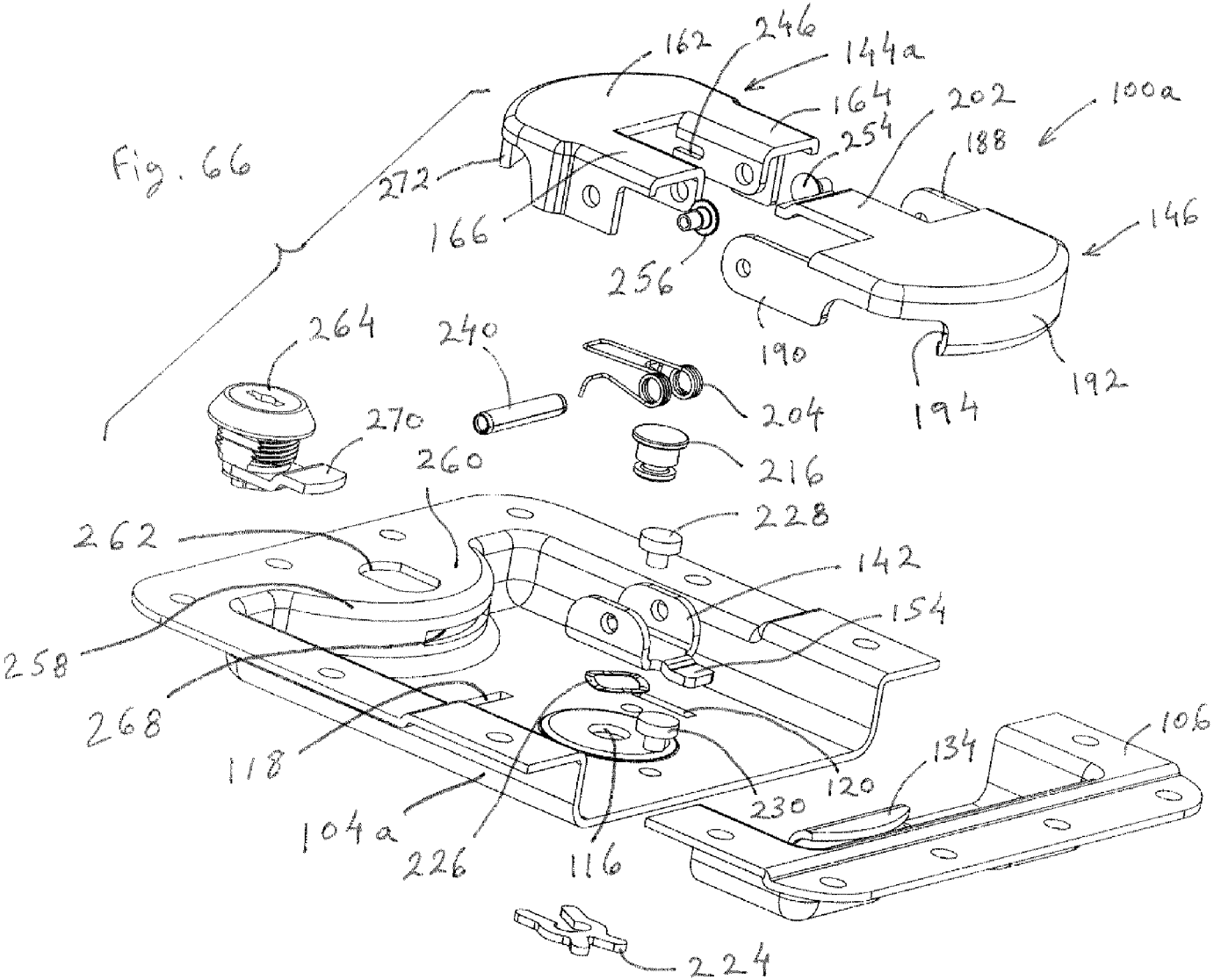
FIG. 66 is an exploded view of the second embodiment of the latching system in accordance with the present invention.
Figures 67, 68, 69:
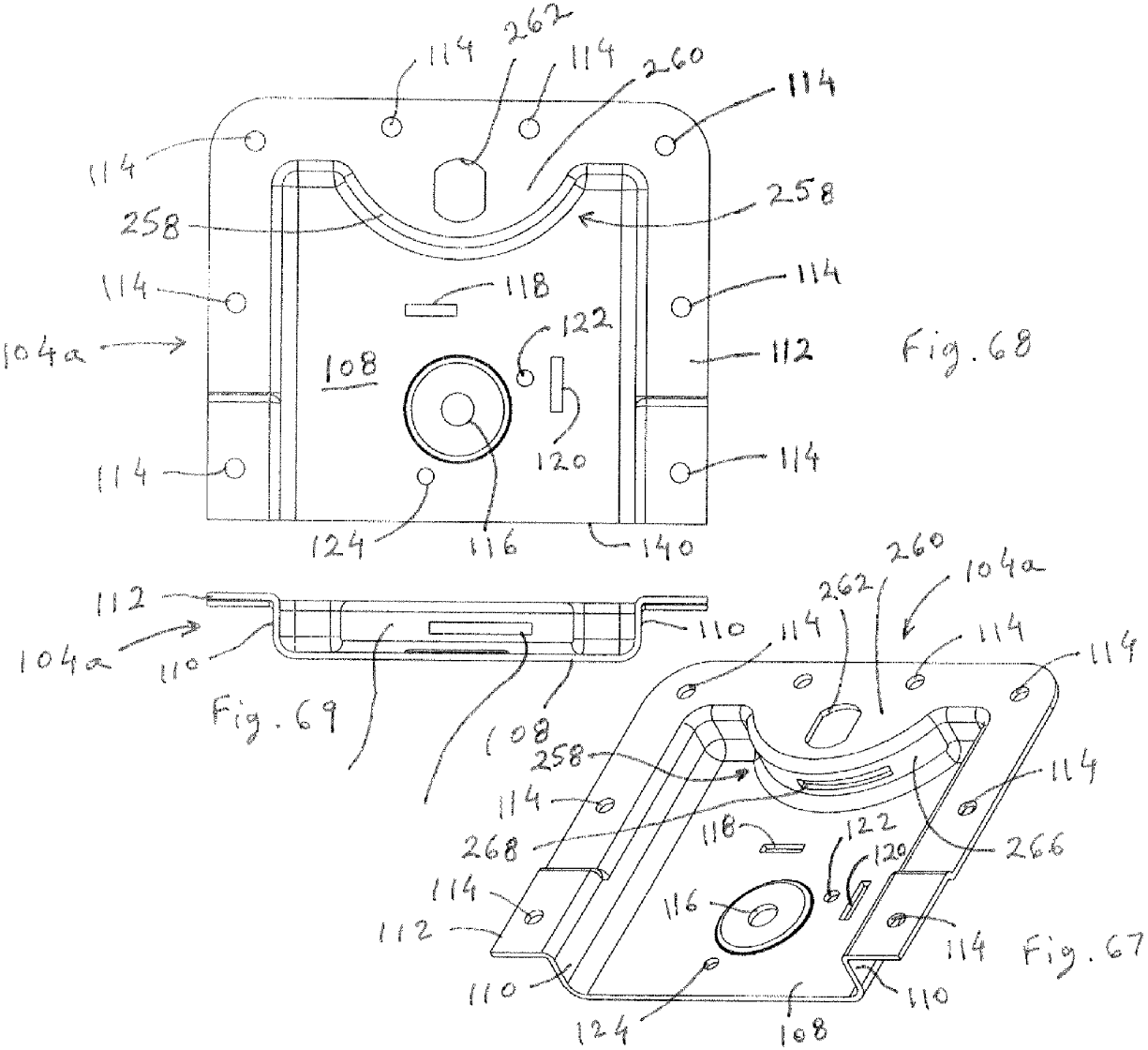
FIGS. 67-71 are views of the cup of the second embodiment of the latching system in accordance with the present invention.
Figures 70, 71:
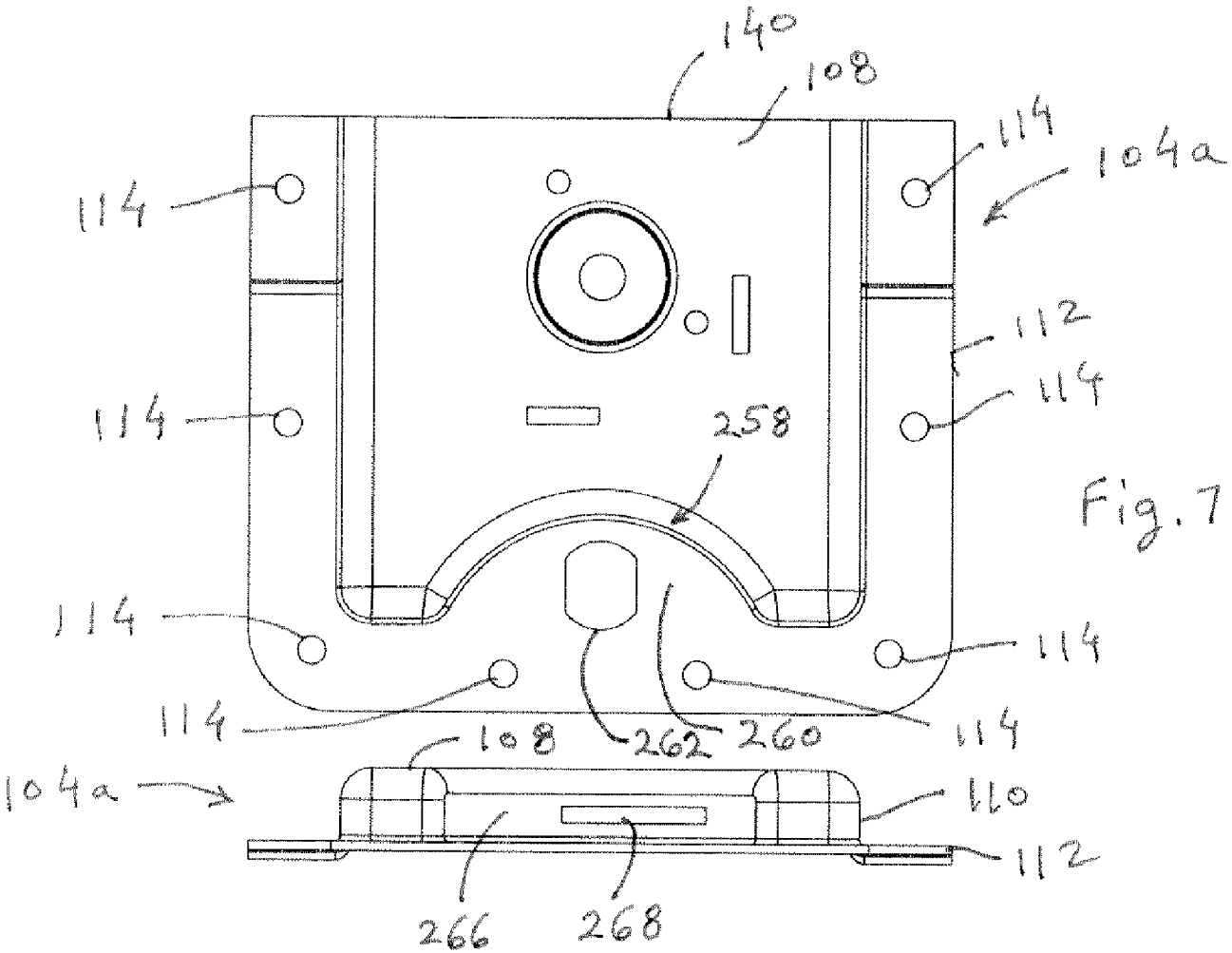
Figure 72:
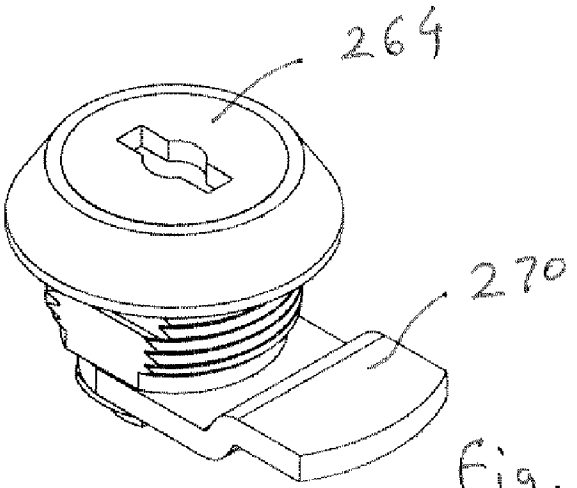
Figure 73:
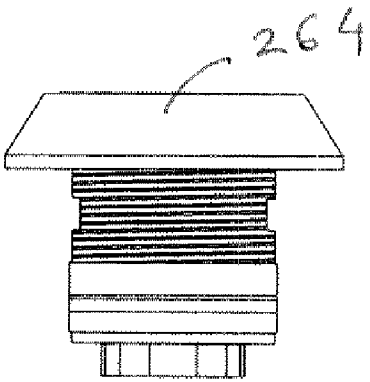
Figure 74:
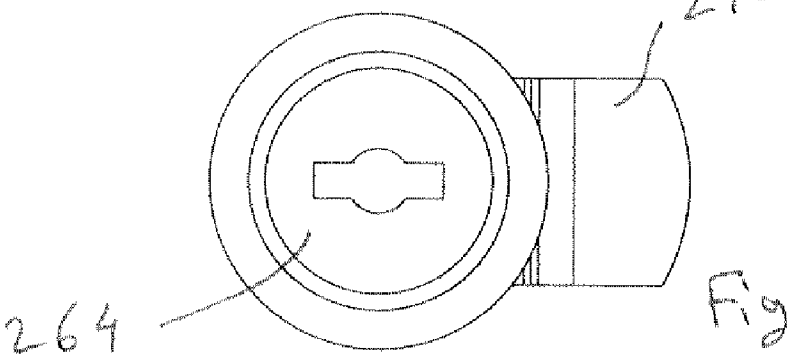
Figure 75:
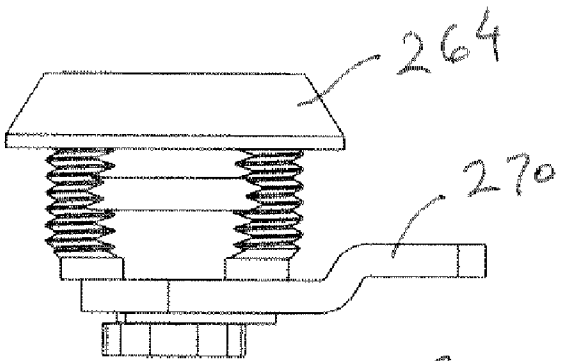
Figure 16:
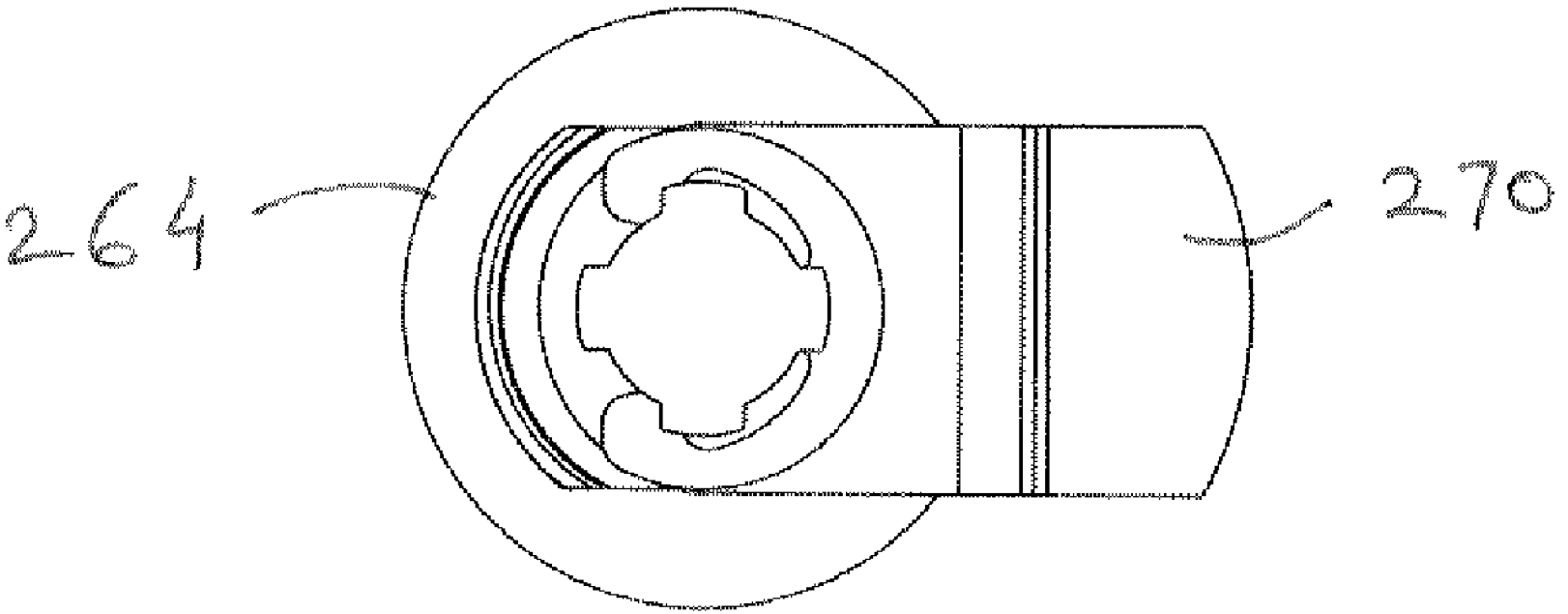
Figures 77, 78, 79, 80, 81:
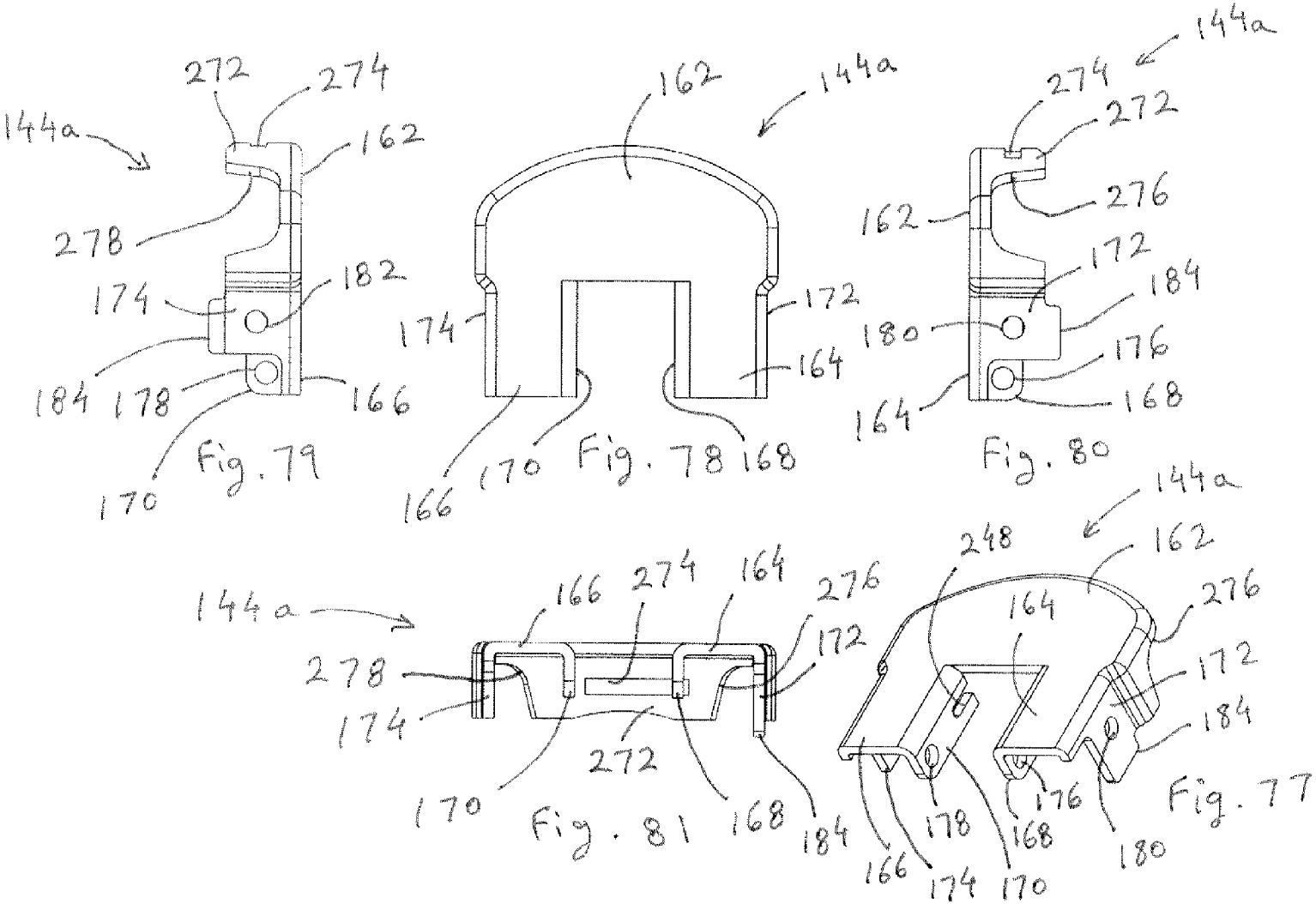
FIGS. 77-83 are views of the lever of the latch assembly of the second embodiment of the latching system in accordance with the present invention.
Figure 82:
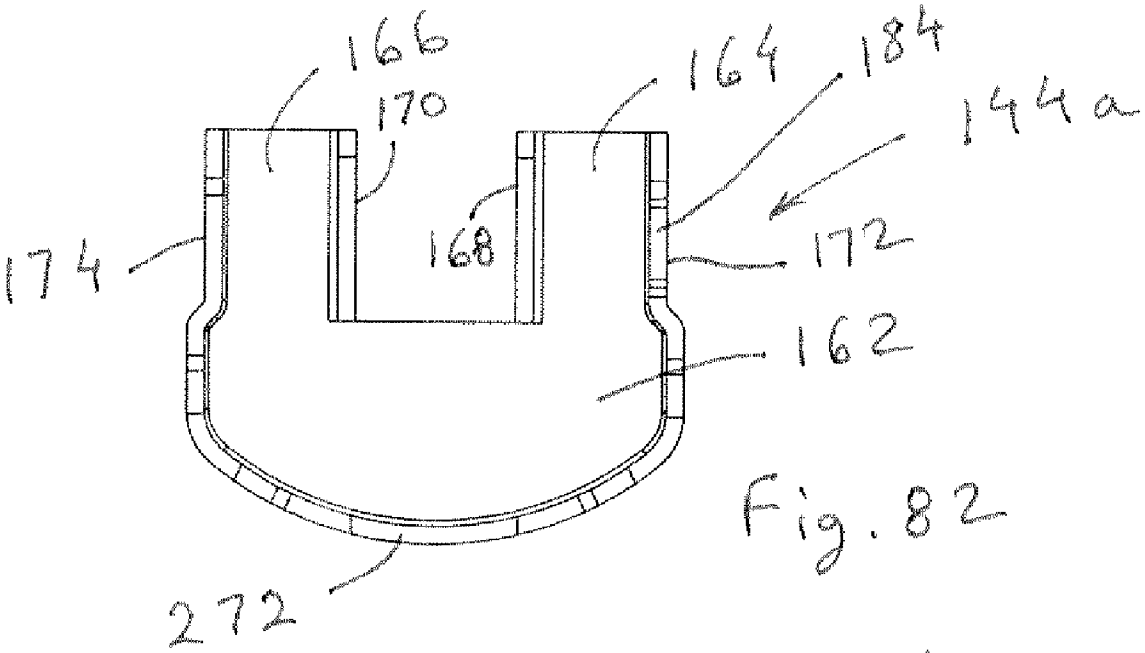
Figure 83:
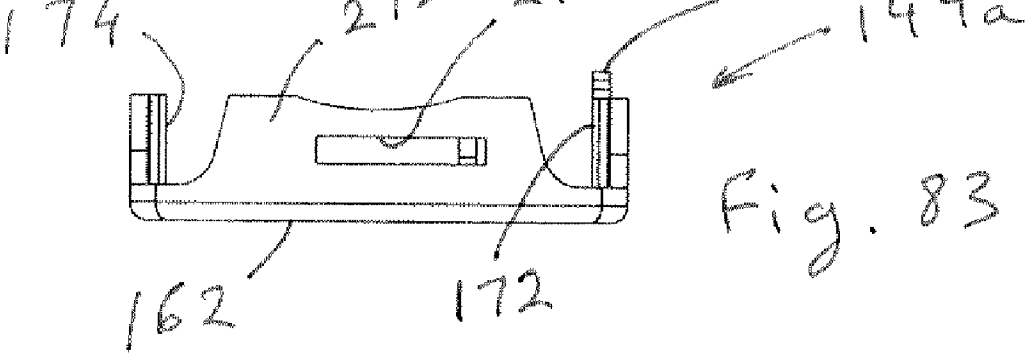
Figure 84:
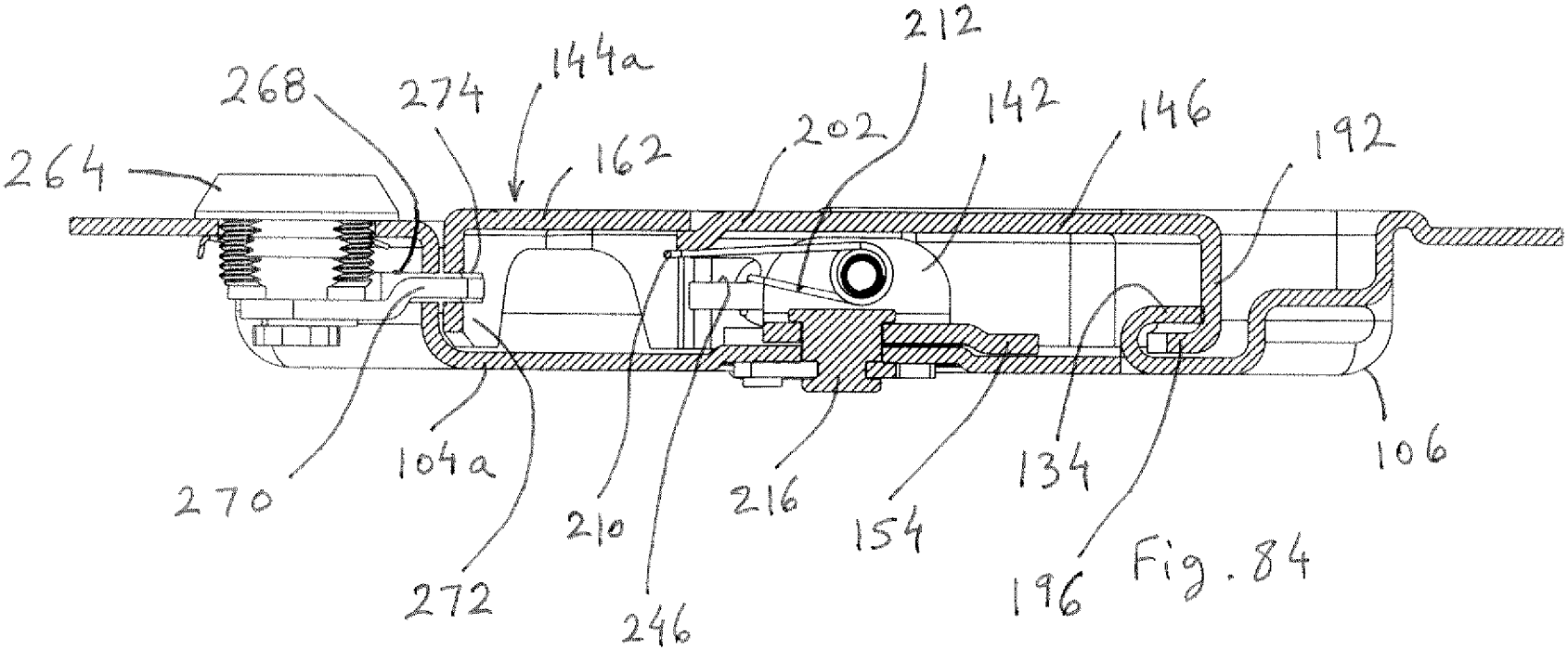
FIGS. 84-85 are cross sectional views of the second embodiment of the latching system in accordance with the present invention, with the latching system shown in a latched condition or configuration, the lock cylinder and the lock pawl shown in the locked position, the lever shown in the latched position, and the catch shown in the latched position.
Figure 85:
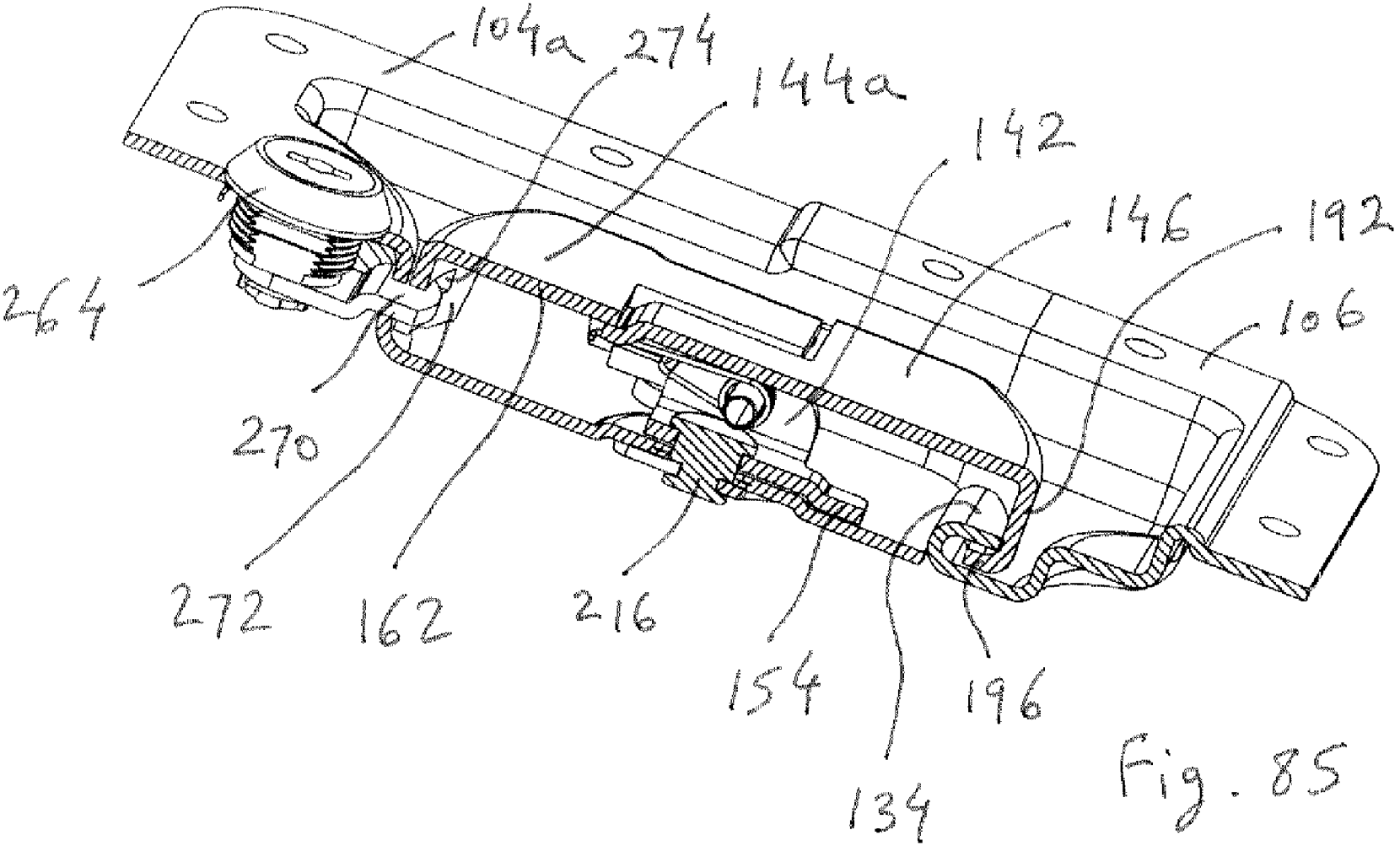
Figure 86:
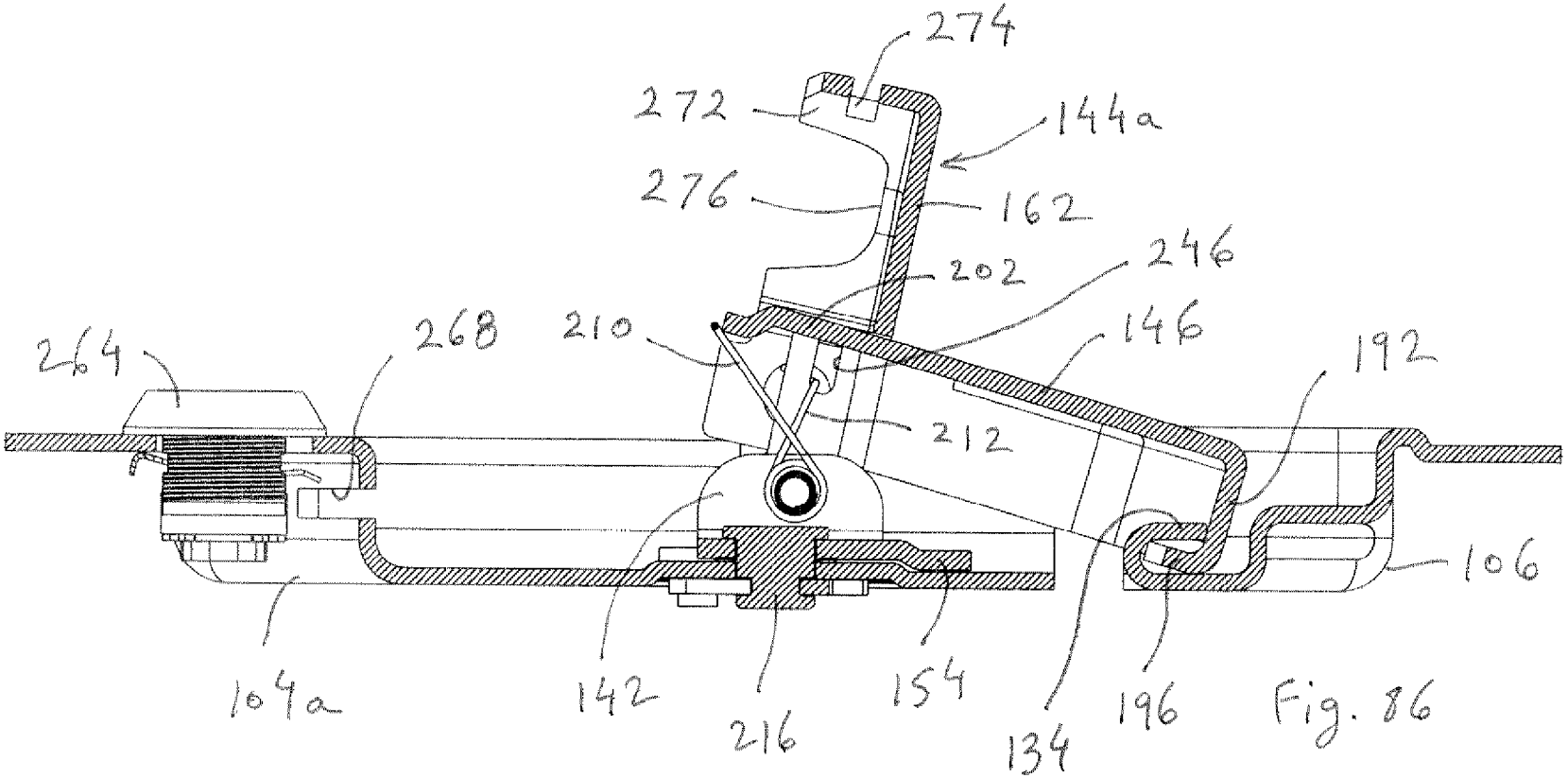
FIGS. 86-87 are cross sectional views of the second embodiment of the latching system in accordance with the present invention, with the latching system shown in an angular position corresponding to the latched condition or configuration, the lock cylinder and the lock pawl shown in the unlocked position, the lever shown in the unlatched position, and the catch shown in the unlatched position.
Figure 87:
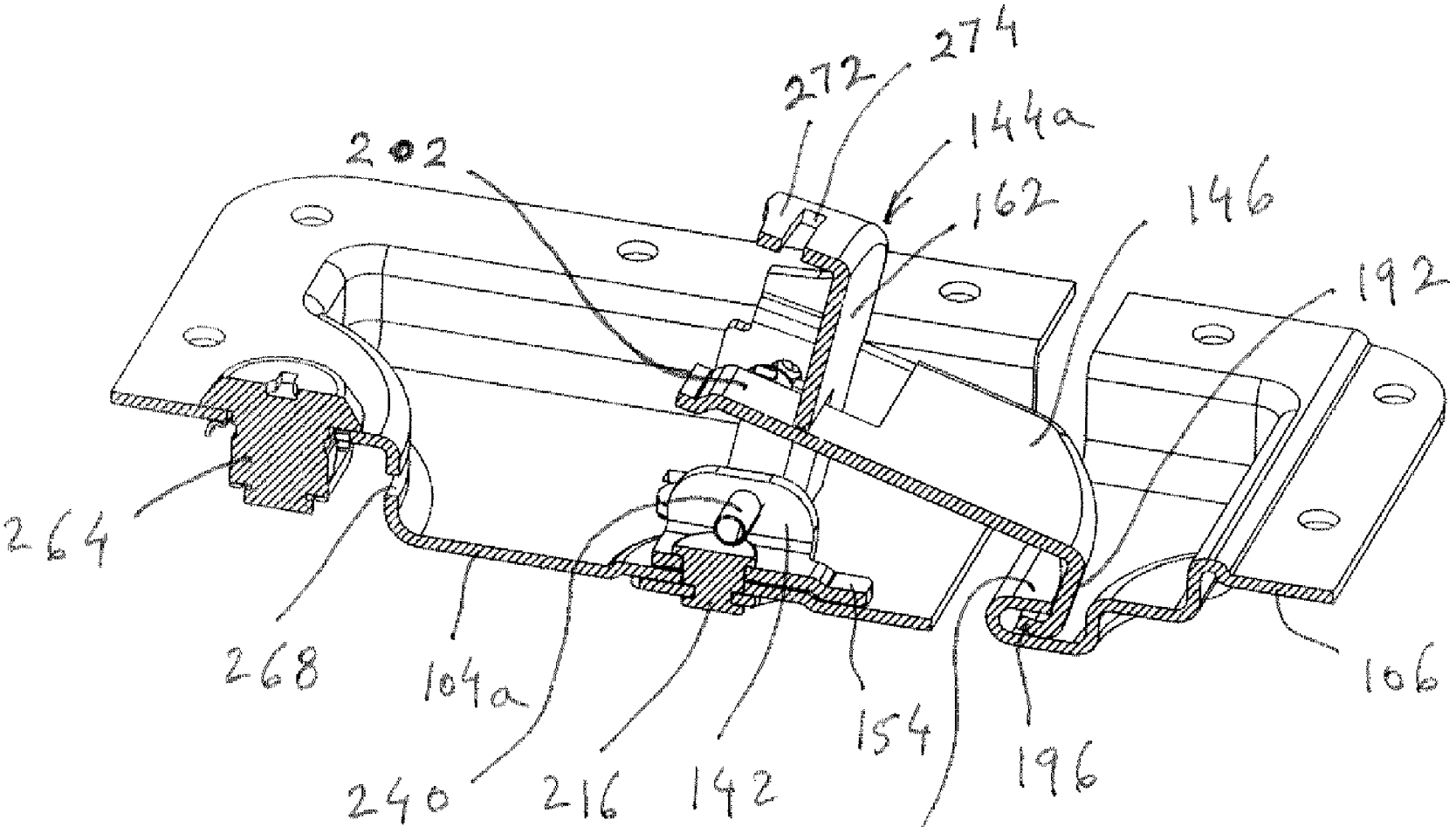
Figure 88:
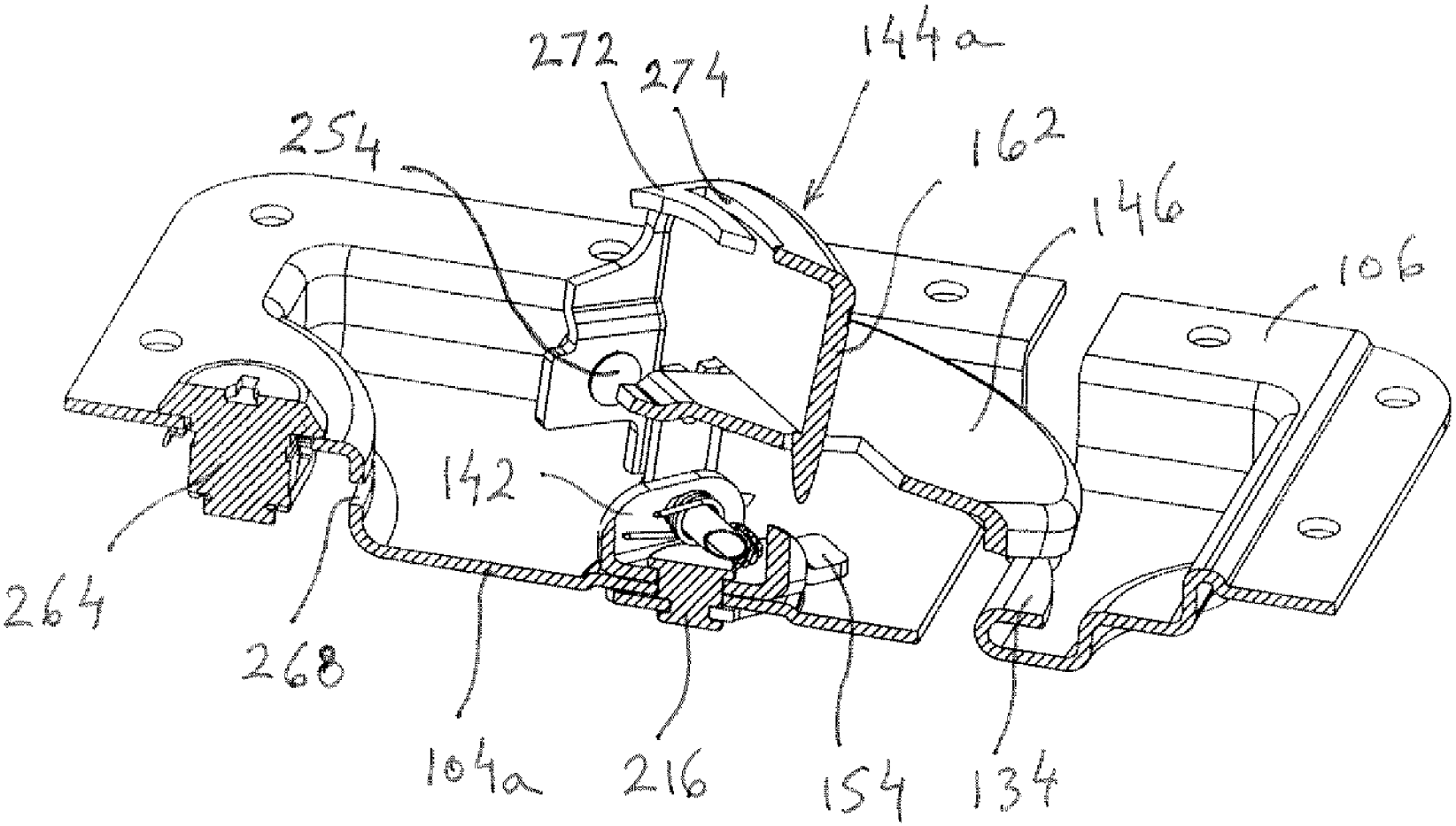
FIG. 88 is a cross sectional view of the second embodiment of the latching system in accordance with the present invention, with the latching system shown rotated 45° from the angular position corresponding to the latched condition or configuration, the lock cylinder and the lock pawl shown in the unlocked position, the lever shown in the unlatched position, and the catch shown in the unlatched position.
Figure 89:
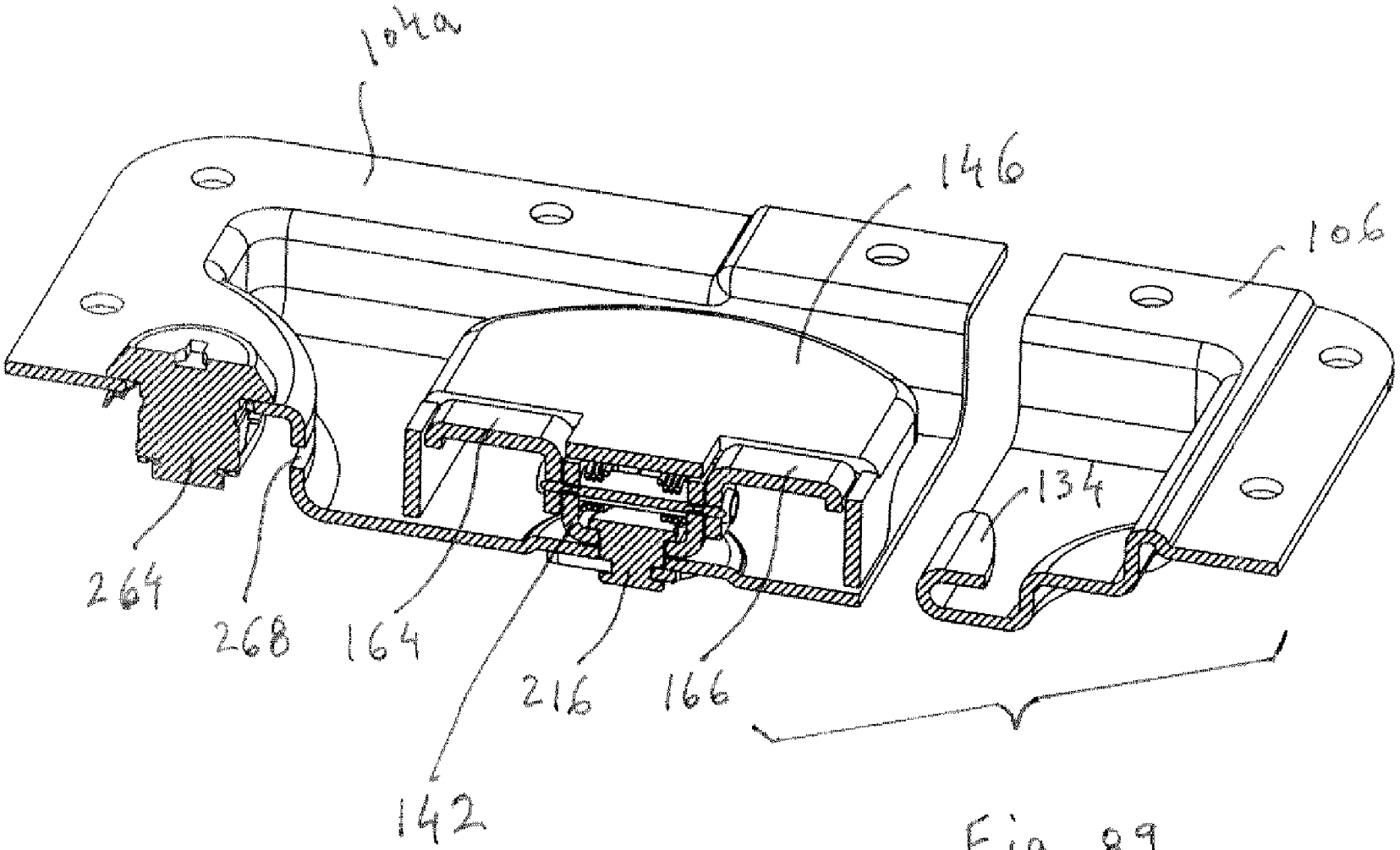
FIG. 89 is a cross sectional view of the second embodiment of the latching system in accordance with the present invention, with the latching system shown in the angular position corresponding to the unlatched condition or configuration, the lock cylinder and the lock pawl shown in the unlocked position, the lever shown in the latched position, and the catch shown in the latched position.

Referring to FIGS. 1-63, a first embodiment 100 of the invention can be seen. The latching system 100 includes a latch assembly 102, a cup 104, and a keeper plate 106. The cup 104 has a bottom plate 108, rising wall 110, and a flange 112. The rising wall 110 surrounds the bottom plate 108 on three sides. The flange 112 is coextensive with the top edge of the rising wall 110, such that the bottom plate 108 is depressed relative to the flange 112. The flange 112 is provided with holes 114 that are distributed along the length of the flange 112 to allow mounting of the cup 104 to the first closure member 101 using any of a wide variety of well known fasteners. The bottom plate 108 has a mounting hole 116 for mounting the latch assembly 102 to the cup 104. Thus the cup 104 provides a depression where the latch assembly 102 is mounted in order to minimize projection of portions of the latch assembly 102 above the outer surface of the first closure member 101. The bottom plate 108 has a pair of rectangular slots 118, 120 provided at the same distance from the center of the mounting hole 116 but separated by an angle of less than 90° about the center of the mounting hole 116. The bottom plate 108 has a pair of smaller holes 122, 124 each provided at the same distance from the center of the mounting hole 116 but separated by an angle of greater than 90° about the center of the mounting hole 116.

The keeper plate 106 has a bottom plate 126, rising wall 128, and a flange 130. The rising wall 128 surrounds the bottom plate 126 on three sides. The flange 130 is coextensive with the top edge of the rising wall 128, such that the bottom plate 126 is depressed relative to the flange 130. The flange 130 is provided with holes 132 that are distributed along the length of the flange 130 to allow mounting of the keeper plate 106 to the second closure member 103 using any of a wide variety of well known fasteners. The keeper plate 106 includes a keeper 134 in the form of a hook-like projection that projects from the bottom plate 126 near the free edge 136 of the keeper plate 106. The keeper 134 has an overhanging lip 138 that overhangs at least some portion of the keeper plate 106. When the cup 104 and the keeper plate 106 are mounted to the first and second closure members 101 and 103 and the first and second closure members 101 and 103 are in the closed position relative to one another, the free edge 136 of the keeper plate 106 abuts the free edge 140 of the cup 104 such that the free edge 136 of the keeper plate 106 and the free edge 140 of the cup 104 are substantially coextensive. The free edge 136 of the keeper plate 106 may be set back slightly from the free edge 140 of the cup 104 in the vicinity of the keeper 134 when the first and second closure members 101 and 103 are in the closed position. The keeper plate 106 also includes a raised platform 141 provided opposite the keeper 134. The platform 141 follows a circular arc in plan view.

The latch assembly 102 includes a base 142, a lever 144, and a catch 146. The lever 144 is pivotally connected to the base 142 and the catch 146 is pivotally connected to the lever 144. The base 142 is in the form of a channel of U-shaped cross section and having a bottom plate 148, first side plate 150, and second side plate 152. The base 142 also includes a tongue 154 that projects outward from the bottom plate 148. The bottom plate 148 is provided with a hole 156. The first side plate 150 is provided with a hole 158, and the second side plate 152 is provided with a hole 160. The holes 158 and 160 are in registry with one another.

The lever 144 has a wide, plate-like paddle portion 162 that is raised above the bottom plate of the cup 104 in the fully assembled latching system 100. The paddle portion 162 is adapted to afford the user of the latching system a grip for grasping and operating the lever 144. The lever 144 also includes a pair of arms 164, 166 extending in parallel from the paddle portion 162. Each arm 164, 166 has an inner wall 168, 170, respectively, and an outer wall 172, 174, respectively. Each inner wall 168, 170 has a hole 176, 178, respectively. Each outer wall 172, 174 has a hole 180, 182, respectively. The holes 180, 182 are closer to the paddle portion 162 as compared to the holes 176, 178. The holes 176, 178 are in registry with one another. The centers of the holes 180, 182 are aligned along a common axis. A rectangular tab 184 projects from the outer wall 172 of the arm 164.

The catch 146 includes a top plate 186 and arms 188 and 190 that extend in parallel from the top plate 186. The arms 188, 190 are spatially separated from one another and project from either side of the top plate 186. A peripheral skirt or wall 192 projects perpendicularly downward from the top plate 186 and extends along the front and sides of the top plate 186. In the illustrated example, the skirt 192 is extended beyond the sides of the top plate 186 to form the arms 188, 190. A cutout 194 is provided in the skirt 192 so that the catch 146 can clear the keeper 134 as the latch assembly 102 is rotated toward the position corresponding to the unlatched configuration. A shelf-like projection 196 projects from the skirt 192 such that the shelf-like projection 196 overhangs a portion of the top plate 186. Also the edge of the projection 196 that is farthest from the skirt 192 forms a lip 198 that also projects from the skirt 192 and overhangs a portion of the top plate 186. The front portion of the top plate 186, the front portion of the skirt 192 and the projection 196 including its lip 198 together form the hook-like portion 200 of the catch 146. The catch 146 also includes a tongue 202 that projects from the top plate 186 intermediate the arms 188 and 190.

The latch assembly 102 further includes a torsion spring 204. The torsion spring 204 includes two coiled portions 206, 208, an elongated loop portion 210 connecting the two coiled portions, and two arms 212, 214 that extend from the coiled portions 206, 208, respectively.

The base 142 is pivotally attached to the bottom plate of the cup 104 using the stud 216. The stud 216 has a head 218 and a shaft 220. The head 218 is too large to fit through the hole 156 of the bottom plate of the base 142. The head 218 is too large to fit through the hole 116 of the bottom plate of the cup 104. The shaft 220 is sized to fit through the holes 156 and 116. The shaft 220 is also provided with a retaining ring groove 222 near its end that is distal from the head 218. The shaft of the stud 216 is positioned to extend through the holes 156 and 116 with the head of the stud 216 in contact with the bottom plate of the base 142 in order to pivotally attach the base 142 to the cup 104. A resilient retaining ring 224 is fitted into the retaining ring groove 222 to keep the stud 216 in place. A resilient wave washer 226 is provided between the retaining ring 224 and the bottom plate of the cup 104 to place the stud 216 in tension and prevent rattling or play between the base 142 and the cup 104. Thus, the base 142 is rotationally attached to the cup 104 and the base 142 is capable of moving rotationally relative to the cup 104 about an axis of rotation essentially perpendicular to the bottom plate of the cup 104.

The stop lugs 228, 230 are attached to the bottom plate of the cup 104 to limit the range of rotational motion of the base 142. Each of the stop lugs 228, 230 is attached to the bottom plate of the cup 104 at a position corresponding to a respective one of the holes 122, 124. Each stop lug 228, 230 has a head 232, 234, respectively, and a shaft 236, 238, respectively. The heads 232, 234 are too large to fit through the holes 122, 124, respectively, of the bottom plate of the cup 104. The shafts 236, 238 are sized to fit through the holes 122 and 124, respectively, of the bottom plate of the cup 104. The shafts 236, 238 are also provided with ends distal from the heads 232, 234 that can be flared out by a flaring tool to fix the stop lugs 228, 230 to the bottom plate of the cup 104. The shaft of each lug 228, 230 is positioned to extend through a respective one of the holes 122, 124 with the head of each lug 228, 230 in contact with the bottom plate of the cup 104. The ends of the shafts of each lug 228, 230 are flared out to fix the lugs 228, 230 to the bottom plate of the cup 104. The tongue 154 of the base 142 is positioned between the stop lugs 228, 230. One side of the tongue 154 contacts the stop lug 230 to stop the rotation of the base 142, and consequently the latch assembly 102, at the position corresponding to the latched configuration, and the other side of the tongue 154 contacts the stop lug 228 to stop the rotation of the base 142, and consequently the latch assembly 102, at the position corresponding to the unlatched configuration. The angular separation between the holes 122, 124, and consequently the angular separation between the stop lugs 228, 230, is selected such that the range of rotational motion of the base 142, and consequently that of the latch assembly 102, between the positions corresponding to the latched and unlatched configurations is about 90°. In addition to the method of attachment of the stop lugs 228, 230 to the cup 104 used in the illustrated example, the stop lugs 228, 230 may also be attached to the cup 104 by using screw threads provided in the holes 122, 124 and on the shafts of the lugs, by making the stop lugs of one piece with the cup 104, by welding the stop lugs to the cup 104, or by any other suitable method.

The arms 164, 166 of the lever 144 are positioned on opposite sides of the base 142 with the holes 176, 178 in registry with the holes 158 and 160 of the base 142. A pin 240 is positioned through the holes 176, 178 and the holes 158, 160 to pivotally attach the lever 144 to the base 142 such that the lever 144 can pivotally move relative to the base 142 at least between a latched position and an unlatched position. The torsion spring 204 is positioned between the first side plate 150 and the second side plate 152 of the base 142 with the lever pivot pin 240 extending through the two coiled portions 206, 208. The two arms 212, 214 of the torsion spring 204 each have a bent portion 242, 244, respectively, at about their tips. Each of the bent portions 242, 244 engages a respective one of the slots 246, 248 formed in the inner walls 168, 170, respectively, of the arms of the lever 144 to immobilize the ends of the arms 212, 214 distal from the coiled portions 206, 208 relative to the lever 144.

The arms 188, 190 of the catch 146 are positioned such that the arms 164, 166 of the lever 144 are positioned at least in part between the arms 188, 190. The hole 250 in arm 188 is in registry with the hole 180 in the outer wall 172 of the arm 164 of the lever 144. The hole 252 in arm 190 is in registry with the hole 182 in the outer wall 174 of the arm 166 of the lever 144. A rivet 254 is positioned to extend through the holes 250 and 180 to pivotally connect the arm 188 of the catch 146 to the arm 164 of the lever 144. A rivet 256 is positioned to extend through the holes 252 and 182 to pivotally connect the arm 190 of the catch 146 to the arm 166 of the lever 144. The longitudinal axes of the rivets 254, 256 coincide with a common axis that defines the axis of rotation or pivot of the catch 146 relative to the lever 144. Thus, the catch 146 is pivotally connected to the lever 144. The rivet 254 has a head that is larger in diameter than the holes 250 and 180 and an end portion that is capable of being flared in order to secure the rivet 254 in position as part of the latch assembly 102. Similarly, the rivet 256 has a head that is larger in diameter than the holes 252 and 182 and an end portion that is capable of being flared in order to secure the rivet 256 in position as part of the latch assembly 102.

When the lever 144 and the catch 146 are in their latched positions, the tongue 202 of the catch 146 is positioned above the base 142 and essentially covers the base 142. The elongated loop 210 of the torsion spring 204 engages the surface of the tongue 202 facing the base 142 near the end of the tongue 202 that is distal from the top plate 186. Relative pivotal movement between the lever 144 and the catch 146 forces the distal end of the tongue 202, and consequently the portion of the loop 210 that is in contact with the tongue 202, toward the ends of the arms 212, 214 distal from the coiled portions 206, 208 of the torsion spring 204. The resilience and geometry of the torsion spring 204 as installed in the latch assembly 102 biases the portion of the loop 210 that is in contact with the tongue 202 to move away from the ends of the arms 212, 214 of the torsion spring 204 that are distal from the coiled portions 206, 208. Accordingly, the lever 144 and the catch 146 are spring biased toward their latched positions relative to the base 142.

When the latch assembly 102 is in the latched configuration and secures the second closure member 103 in the closed position relative to the first closure member 101, the catch 146 engages the keeper 134, the catch 146 and the lever 144 are in their latched positions relative to the base 142, and the tab 184 engages the slot 120 to prevent rotation of the latch assembly 102. Also, in this configuration, the base 142 is in its latched position and a compressive force is generated between the first closure member 101 and the second closure member 103 that could, for example, be compressing a sealing gasket (not shown) provided between the first closure member 101 and the second closure member 103. Accordingly, the catch 146 is in tension. Furthermore, the lip 138 overhangs the projection 196 such that the catch 146 cannot be lifted away from the bottom plate of the keeper plate 106.

To unlatch the latch assembly 102 and open the closure members 101 and 103, the lever 144 is lifted up and away from the bottom plate of the cup 104 to lever 144 from the latched position to the unlatched position. In this process, the tab 184 is removed from the slot 120 freeing the latch assembly 102 for rotation about the stud 216. Also, as the lever 144 is moved to the unlatched position the axis of rotation of the catch 146 relative to the lever 144 moves along a circular arc centered at the axis of rotation of the lever 144 relative to the base 142, and when the lever 144 is in the unlatched position in relation to the base 142, the axis of rotation of the catch 146 relative to the lever 144 is positioned closer to the keeper 134 as compared to the position of the axis of rotation of the catch 146 relative to the lever 144 when the lever 144 is in the latched position. Consequently, when the lever 144 is moved from the latched position to in the unlatched position in relation to the base 142, the front portion of the skirt 192 is moved away from the base 142 and the keeper 134 thereby eliminating at least some of the tension in the catch 146 and consequently eliminating at least some of the frictional force between the catch 146 and the keeper 134. Once the lever 144 is in the unlatched position relative to the base 142, it affords a good grip for rotating the latch assembly 102 about the stud 216 toward the angular position corresponding to the unlatched configuration of the latch assembly 102. The latch assembly 102 is rotated about 90° about the stud 216 to place the latch assembly 102 in the angular position corresponding to the unlatched configuration of the latch assembly 102. In this process, the catch 146 clears the keeper 134 due to the keeper 134 "exiting" the catch 146 through the cutout 194, and the closure member 103 can then be moved to the open position relative to the closure member 101. Once the latch assembly 102 is in the position corresponding to the unlatched position and the lever 144 is pushed down to the latched position relative to the base 142 by the user where the tab 184 is inserted into the slot 118 to keep the latch assembly 102 from rotating out of the angular position corresponding to the unlatched configuration of the latch assembly 102. As the lever 144 is pushed down the catch 146 is also returned to its latched position relative to the base 142. The spring bias due to spring 204 maintains the catch 146 and the lever 144 in their latched positions relative to the base 142. Alternatively, the lever 144 can be released by the user and the spring bias due to spring 204 returns the catch 146 and the lever 144 to their latched positions relative to the base 142.

The raised platform 141 is positioned close enough to the keeper 134 such that the movement of the catch 146 relative to the keeper 134, as the lever 144 is moved from the latched position to the unlatched position, is limited to such an extent that the shelf-like projection 196 cannot be completely withdrawn from underneath the lip 138 of the keeper 134. Therefore, the catch 146 cannot be simply lifted off the keeper 134 and the latch assembly 102 must be rotated to release the keeper 134 from the catch 146.

In the unlatched configuration, the lever 144 and the catch 146 lie substantially flush with the surface of the flange 112 and no part of the latch assembly 102 protrudes beyond the edge 140 of cup 104 or the edge of the first closure member 101 where it can snag the clothing of the user or cause damage to other articles by accidental impact.

With the latch assembly 102 initially in the latched configuration and securing the second closure member 103 in the closed position relative to the first closure member 101, as the lever 144 is moved from the latched position to the unlatched position in relation to the base 142, the lever 144 moves through an intermediate position that is intermediate the latched and unlatched positions and in which the axis of rotation of the catch 146 relative to the lever 144 is positioned slightly farther from the keeper 134 as compared to the position of the axis of rotation of the catch 146 relative to the lever 144 when the lever 144 is in the latched position. Consequently, when the catch 146 is in tension and the lever 144 is in the latched position, the lever 144 tends to stay in the latched position rather than becoming spontaneously unlatched. This characteristic is what is denoted by the adjective "over center."

The lip 138 is arc shaped and follows the arc or curvature of the front portion of the skirt 192. The curvature of the front portion of the skirt 192 follows a circular arc centered at the center of the hole 116 of the cup 104 through which the stud 216 passes. This arrangement facilitates the rotational disengagement of the catch 146 from the keeper 134.

To once again secure the closure members 101 and 103 in the closed position, the lever 144 is lifted to disengage the tab 184 from the slot 118 in the cup 104 and to move the front portion of the catch 146 including the projection 196 into an extended position relative to the base 142 corresponding to the unlatched position of the catch 146. The latch assembly 102 is then rotated using the lever 144 so that the catch 146 slides over the keeper 134 with the projection 196 being positioned underneath the lip 138 of the keeper 134. When the lever 144 is rotated about 90° to the angular position corresponding to the latched configuration of the latch assembly 102, the tongue 154 of the base 142 contacts the stop lug 230, which stops further rotation. The lever 144 can then be moved to the latched position to bring the catch 146 into engagement with the keeper 134 and draw the closure member 103 into the closed position relative to the closure member 101.

As noted above, the keeper lip 138 has a radius of curvature that matches the radius of curvature of the inside of the front portion of the skirt 192 of the catch 146. Alternatively, the radius of curvature of the keeper lip 138 could be made substantially smaller than the radius of the circular arc along which the front portion of the skirt 192 swings as the latch assembly 102 is rotated. In this case the inside of the front portion of the skirt 192 of the catch 146 would act like a cam against the keeper lip 138 providing pull-up action to draw the closure member 103 toward the closure member 101 during the rotation of the latch assembly 102.

Referring to FIGS. 64-89, a second embodiment 100*a* of the latching system of the present invention can be seen. The embodiment 100*a* is identical to the embodiment 100 in all respects except for the addition of a locking feature that allows a user to control access to the items secured by the latching system using a key operated lock. The cup 104*a* has a semicircular bulge 258 positioned to be behind the lever 144*a* when the latch assembly 102*a* is in the latched configuration. The top plate 260 of the bulge is provided with a hole 262 that has flat sides to accommodate a conventional key operated lock 264. The hole 262 provides for mounting of the lock 264 to the cup 104*a*. The front wall 266 of the bulge 258 has a slot 268 that allows the lock pawl 270 of the lock 264 to pass through the front wall of the bulge and engage the lever 144*a* when the lock 264 is in the locked position. When the proper key is inserted in the lock 264, the pawl 270 can be selectively rotated between locked and unlocked positions.

The lever 144*a* is provided with a skirt 272 that extends down from the rear edge of the paddle portion 162*a* and faces the front wall 266 of the bulge 258 when the latch assembly 102*a* is in the latched configuration. The skirt 272 has a slot 274 that registers with the slot 268 when the latch assembly 102*a* is in the latched configuration. When the lock 264 and the pawl 270 are rotated to the locked position, the pawl 270 is positioned to extend into the slot 274 to thereby prevent the lever 144*a* from being lifted toward the unlatched position. When the lock 264 and the pawl 270 are rotated to the unlocked position, the pawl 270 is completely withdrawn from the slot 274 to thereby allow the lever 144*a* to be lifted toward the unlatched position. The latching system 100*a* can then be operated in exactly the same manner as described in reference to the latching system 100.

The latch assembly 102*a* is highly tamper resistant because the catch 146 almost completely covers and conceals the keeper 134. This feature makes it almost impossible to pry back the keeper 134 with a tool such as a screw driver to release the catch 146 and open the latch assembly.

Openings are left on either side of the skirt 272 to provide finger holes 276, 278 that make it easier for a user to grasp and lift the lever 144*a*.

Referring to FIGS. 84-89, the latched and unlatched positions of the lever 144 and of the catch 146 relative to the base 142 in embodiment 100 are exactly the same as those illustrated for the lever 144*a* and the catch 146 with respect to embodiment 100*a*. Furthermore, the relationships between the lever 144, the catch 146, and the base 142 and the relationships between the lever 144, the catch 146, the base 142, and the keeper 134 in embodiment 100 are exactly the same as those illustrated for the lever 144*a*, the catch 146, the base 142, and the keeper 134 with respect to embodiment 100*a* in all respects.

The present invention is not limited to the illustrative embodiments described above, but includes any and all embodiments within the scope of the appended claims.

The invention claimed is:

1. An over-center draw latch for securing a first closure member in a closed position relative to a second closure member, the second closure member being provided with a keeper, the latch comprising:

a base;

a lever pivotally connected to said base, said lever being pivotally movable relative to said base about a first axis of rotation;

a catch pivotally connected to said lever, said catch being pivotally movable relative to said lever about a second axis of rotation, said second axis of rotation being parallel to said first axis of rotation, said catch being adapted for engaging the keeper to secure the second closure member in the closed position relative to the first closure member when the latch is in a latched configuration and said base is mounted to the first closure member; and a spring, wherein said catch and said lever are biased by said spring toward respective positions corresponding to said latched configuration, wherein said base is adapted for being pivotally mounted to the first closure member such that said base is pivotally movable about a third axis of rotation that is perpendicular in direction to said first axis of rotation, and wherein said catch can clear the keeper when, with the latch initially in said latched configuration, said lever is lifted and the latch rotated about said third axis of rotation.

2. An over-center draw latch system for securing a first closure member in a closed position relative to a second closure member, the latch system comprising:

a keeper adapted for attachment to the second closure member; and a latch comprising:

a base;

a lever pivotally connected to said base, said lever being pivotally movable relative to said base about a first axis of rotation;

a catch pivotally connected to said lever, said catch being pivotally movable relative to said lever about a second axis of rotation, said second axis of rotation being parallel to said first axis of rotation, said catch being adapted for engaging said keeper to secure the second closure member in the closed position relative to the first closure member when the latch is in a latched configuration and said base is mounted to the first closure member; and a spring, wherein said catch and said lever are biased by said spring toward respective positions corresponding to said latched configuration, wherein said base is adapted for being pivotally mounted to the first closure member such that said base is pivotally movable about a third axis of rotation that is perpendicular in direction to said first axis of rotation, and wherein said catch can clear said keeper when, with the latch initially in said latched configuration, said lever is lifted and the latch rotated about said third axis of rotation in order to allow the opening of the first closure member relative to the second closure member.

3. The over-center draw latch system according to claim 2, wherein said keeper is part of a keeper plate, wherein said keeper plate is provided with a raised platform opposite said keeper, and wherein said raised platform limits the movement of said catch away from said keeper as said lever is lifted such that the latch must be rotated for said catch to clear said keeper.

4. The over-center draw latch system according to claim 3, wherein said lever is provided with two arms that are positioned on either side of said base, and wherein said catch is provided with two arms that are positioned on either side of said lever.

5. The over-center draw latch system according to claim 3, wherein said catch is provided with a tongue that covers said base when said latch is in said latched configuration.

6. The over-center draw latch system according to claim 5, wherein said lever is provided with two arms that are positioned on either side of said base, and wherein said catch is provided with two arms that are positioned on either side of said lever.

7. The over-center draw latch system according to claim 2, wherein said catch is provided with a tongue that covers said base when said latch is in said latched configuration.

8. The over-center draw latch system according to claim 7, wherein said lever is provided with two arms that are positioned on either side of said base, and wherein said catch is provided with two arms that are positioned on either side of said lever.

9. The over-center draw latch system according to claim 2, wherein said lever is provided with two arms that are positioned on either side of said base, and wherein said catch is provided with two arms that are positioned on either side of said lever.

* * * * *